US010083703B2

(12) United States Patent
Moriya et al.

(10) Patent No.: US 10,083,703 B2
(45) Date of Patent: Sep. 25, 2018

(54) FREQUENCY DOMAIN PITCH PERIOD BASED ENCODING AND DECODING IN ACCORDANCE WITH MAGNITUDE AND AMPLITUDE CRITERIA

(71) Applicant: NIPPON TELEGRAPH AND TELEPHONE CORPORATION, Tokyo (JP)

(72) Inventors: Takehiro Moriya, Kanagawa (JP); Yutaka Kamamoto, Kanagawa (JP); Noboru Harada, Kanagawa (JP); Yusuke Hiwasaki, Tokyo (JP); Masahiro Fukui, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 15/904,140

(22) Filed: Feb. 23, 2018

(65) Prior Publication Data

US 2018/0182405 A1 Jun. 28, 2018

Related U.S. Application Data

(63) Continuation of application No. 14/391,534, filed as application No. PCT/JP2013/064209 on May 22, 2013, now Pat. No. 9,947,331.

(30) Foreign Application Priority Data

May 23, 2012 (JP) ..... 2012-117172
Aug. 1, 2012 (JP) ..... 2012-171155

(51) Int. Cl.
*G10L 19/00* (2013.01)
*G10L 19/09* (2013.01)
(Continued)

(52) U.S. Cl.
CPC ..... *G10L 19/09* (2013.01); *G10L 25/90* (2013.01); *G10L 19/0017* (2013.01);
(Continued)

(58) Field of Classification Search
None
See application file for complete search history.

(56) References Cited

U.S. PATENT DOCUMENTS 4,797,926 A 1/1989 Bronson et al.
5,003,604 A 3/1991 Okazaki et al.
(Continued)

FOREIGN PATENT DOCUMENTS

EP 0 260 053 A1 3/1988
EP 0 333 121 A2 9/1989
(Continued)

OTHER PUBLICATIONS

International Search Report dated Aug. 27, 2013 in PCT/JP2013/064209 filed May 22, 2013.
(Continued)

*Primary Examiner* — Richard Zhu
(74) *Attorney, Agent, or Firm* — Oblon, McClelland, Maier & Neustadt, L.L.P.

(57) ABSTRACT

A frequency-domain sample interval corresponding to a time-domain pitch period L corresponding to a time-domain pitch period code of an audio signal in a given time period is obtained as a converted interval $T_1$, a frequency-domain pitch period T is chosen from among candidates including the converted interval $T_1$ and integer multiples $U \times T_1$ of the converted interval $T_1$, and a frequency-domain pitch period code indicating how many times the frequency-domain pitch period T is greater than the converted interval $T_1$ is obtained.
(Continued)

The frequency-domain pitch period code is output so that a decoding side can identify the frequency-domain pitch period T.

6 Claims, 16 Drawing Sheets

(51) Int. Cl.

| | |
|---|---|
| ***G10L 25/90*** | (2013.01) |
| *G10L 19/032* | (2013.01) |
| *G10L 19/02* | (2013.01) |
| *G10L 19/08* | (2013.01) |

(52) U.S. Cl.
CPC ..... *G10L 19/0212* (2013.01); *G10L 19/032* (2013.01); *G10L 19/08* (2013.01); *G10L 2025/903* (2013.01); *G10L 2025/906* (2013.01)

(56) References Cited

U.S. PATENT DOCUMENTS

| | | | | |
|---|---|---|---|---|
| 5,127,053 | A * | 6/1992 | Koch | G10L 25/90 704/207 |
| 5,819,212 | A * | 10/1998 | Matsumoto | G10L 19/0208 704/219 |
| 5,839,110 | A * | 11/1998 | Maeda | H04B 1/38 704/275 |
| 6,470,310 | B1 * | 10/2002 | Oshikiri | G10L 19/08 704/205 |
| 2002/0111800 | A1 * | 8/2002 | Suzuki | G10L 19/04 704/220 |
| 2006/0089833 | A1 * | 4/2006 | Su | G10L 19/09 704/230 |
| 2006/0173677 | A1 * | 8/2006 | Sato | G10L 19/24 704/223 |
| 2007/0106502 | A1 * | 5/2007 | Kim | G10L 19/12 704/207 |
| 2008/0126083 | A1 * | 5/2008 | Moriya | G10L 19/0017 704/219 |
| 2009/0125300 | A1 | 5/2009 | Oshikiri | |
| 2012/0093213 | A1 * | 4/2012 | Moriya | G10L 19/18 375/240 |
| 2014/0081629 | A1 * | 3/2014 | Gao | G10L 25/93 704/208 |

FOREIGN PATENT DOCUMENTS

| | | | |
|---|---|---|---|
| JP | 2009-156971 | A | 7/2009 |
| KR | 10-2007-0083856 | A | 8/2007 |
| WO | WO 2012/046685 | A1 | 4/2012 |

OTHER PUBLICATIONS

Takehiro Moriya, et al., "A Design of Transform Coder for Both Speech and Audio Signals at 1 Bit/Sample," IEEE, Proc. ICASSP'97, 1997, pp. 1371-1374.
Juergen Herre, et al., "The Integrated Filterbank Based Scalable MPEG-4 Audio Coder," 105th Convention Audio Engineering Society, vol. 4810, Sep. 26-29, 1998, 20 Pages.
Office Action dated Nov. 6, 2015 in Korean Patent Application No. 10-2014-7030874 with English translation.
Extended European Search Report dated Dec. 10, 2015 in Patent Application No. 13793620.9.
Office Action dated Jun. 9, 2016 in Korean Patent Application No. 10-2014-7030874 (with English language translation).
Combined Office Action and Search Report dated Jun. 29, 2016 in Chinese Patent Application No. 201380026430.4 (with English translation).
Office Action dated Aug. 2, 2016 in European Patent Application No. 13 793 620.9.
Office Action dated Aug. 23, 2016 in Korean Patent Application No. 10-2016-7018299 (with English language translation).
Office Action dated Nov. 25, 2016 in European Patent Application No. 13 793 620.9.
Summons to Attend Oral Proceedings dated May 8, 2017, in European Patent Application No. 13793620.9.

* cited by examiner

Fig. 12

| FREQUENCY-DOMAIN PITCH PERIOD | VARIABLE-LENGTH CODE (FREQUENCY-DOMAIN PITCH PERIOD CODE) |
|---|---|
| $2T_1$ | 00 |
| $3T_1$ | 01 |
| $4T_1$ | 100 |
| $5T_1$ | 101 |
| ⋮ | ⋮ |
| $1.9375T_1$ | 111100 |
| $2.0625T_1$ | 111101 |
| $2.125T_1$ | 111110 |
| ⋮ | ⋮ |
| $3.0625T_1$ | 11111111 |

Fig. 13

| FREQUENCY-DOMAIN PITCH PERIOD | VARIABLE-LENGTH CODE (FREQUENCY-DOMAIN PITCH PERIOD CODE) |
|---|---|
| $T_1$ | 0 |
| ⋮ | ⋮ |
| $1.9375T_1$ | 10100 (10+100) INTEGER MULTIPLE CODE + NEIGHBORHOOD CORRECTION CODE |
| $2T_1$ | 100(10+0) |
| $2.0625T_1$ | 10101(10+101) |
| $2.125T_1$ | 10110(10+110) |
| ⋮ | ⋮ |
| $2.9375T_1$ | 110100(110+100) |
| $3T_1$ | 1100(110+0) |
| $3.0625T_1$ | 1100101(110+101) |
| ⋮ | ⋮ |
| $4T_1$ | 11100(1110+0) |
| ⋮ | ⋮ |
| $5T_1$ | 111100(11110+0) |
| ⋮ | ⋮ |
| $8T_1$<br>$9T_1$ | 11111110 WITHOUT NEIGHBORHOOD CORRECTION<br>11111111 WITHOUT NEIGHBORHOOD CORRECTION |

FREQUENCY DOMAIN PITCH PERIOD BASED ENCODING AND DECODING IN ACCORDANCE WITH MAGNITUDE AND AMPLITUDE CRITERIA

CROSS-REFERENCE TO RELATED APPLICATIONS

The present application is a continuation of and claims the benefit of priority under 35 U.S.C. § 120 from U.S. application Ser. No. 14/391,534, filed Oct. 9, 2014, the entire contents of which is hereby incorporated herein by reference and is a national stage of International Application No. PCT/JP2013/064209, filed May 22, 2013, which claims the benefit of priority under 35 U.S.C. § 119 to Japanese Patent Application No. 2012-117172, filed May 23, 2012, and Application No. 2012-171155, filed Aug. 1, 2012.

TECHNICAL FIELD

The present invention relates to a technique to encode an audio signal and a technique to decode code strings obtained by the encoding technique and, in particular, to encoding of sample strings in the frequency domain obtained by transforming an audio signal into the frequency domain and decoding of the resulting code strings.

BACKGROUND ART

Adaptive encoding that encodes orthogonal coefficients such as DFT (Discrete Fourier Transform) and MDCT (Modified Discrete Cosine Transform) coefficients is known as a method for encoding speech signals and audio signals at low bit rates (for example about 10 to 20 kbits/s). For example, AMR-WB+(Extended Adaptive Multi-Rate Wideband), which is a standard technique, has the TCX (transform coded excitation) encoding mode in which DFT coefficients are normalized and vector-quantized every 8 samples.

In TwinVQ (Transform domain Weighted Interleave Vector Quantization), all MDCT coefficients are rearranged according to a fixed rule and the resulting collection of samples is combined into vectors and encoded. In some cases of TwinVQ, a method is used in which large components are extracted from the MDCT coefficients, for example, in every pitch period in the time domain, information corresponding to the pitch period in the time domain is encoded, the remaining MDCT coefficient strings after the extraction of the large components in every pitch period in the time domain are rearranged, and the rearranged MDCT coefficient strings are vector-quantized every predetermined number of samples. Examples of references on TwinVQ include Non-patent literatures 1 and 2.

An example of technique to extract samples at regular intervals for encoding is the one disclosed in Patent literature 1.

PRIOR ART LITERATURE

Patent Literature

Patent literature 1: Japanese Patent Application Laid-Open No. 2009-156971

Non-Patent Literature

Non-patent literature 1: T. Moriya, N. Iwakami, A. Jin, K. Ikeda, and S. Miki, "A Design of Transform Coder for Both Speech and Audio Signals at 1 bit/sample," Proc. ICASSP '97, pp. 1371-1374, 1997.

Non-patent literature 2: J. Herre, E. Allamanche, K. Brandenburg, M. Dietz, B. Teichmann, B. Grill, A. Jin, T. Moriya, N. Iwakami, T. Norimatsu, M. Tsushima, T. Ishikawa, "The Integrated Filterbank Based Scalable MPEG-4, Audio Coder," 105th Convention Audio Engineering Society, 4810, 1998.

SUMMARY OT THE INVENTION

Problem to be Solved by the Invention

Since encoding based on TCX, such as AMR-WB+, does not take into consideration variations in the amplitude of frequency-domain sample strings based on periodicity, the efficiency of encoding decreases when sample strings with widely varying amplitudes are encoded together. In order to improve the efficiency of encoding, it is effective to encode different sample groups with small amplitude variations in accordance with different criteria based on the pitch periods of sample strings in the frequency domain.

However, there is not a known method for efficiently determining a pitch period of a sample string in the frequency domain to encode the sample string.

In light of the technical background described above, an object of the present invention is to provide a technique capable of efficiently determining a pitch period of a sample string in the frequency domain in encoding and identifying the pitch period of the sample string in the frequency domain in decoding.

Means to Solve the Problems

According to the encoding technique of the present invention, a frequency-domain sample interval corresponding to a time-domain pitch period L corresponding to a time-domain pitch period code of an audio signal in a given time period is obtained as a converted interval $T_1$, a frequency-domain pitch period T is chosen from among candidates including the converted interval $T_1$ and integer multiples $U \times T_1$ of the converted interval $T_1$, and a frequency-domain pitch period code indicating how many times frequency-domain pitch period T is greater than the converted interval $T_1$ is obtained. The frequency-domain pitch period code is output so that a decoding side can identify the frequency-domain pitch period T.

Effects of the Invention

According to the present invention, since a frequency-domain pitch period T is found among integer multiples of a converted interval, the amount of computation required for finding the frequency-domain pitch period T is small. Furthermore, since information representing how many times the frequency-domain pitch period T is greater than the converted interval is used as information for identifying the frequency-domain pitch period T, the code amount of a frequency-domain pitch period code can be kept small. Thus, a pitch period of a frequency-domain sample string can be efficiently determined in encoding and the pitch period of the frequency-domain sample string can be identified in decoding.

BRIEF DESCRIPTION OF THE DRAWINGS

FIG. 12 is a diagram illustrating a variable-length code book according to an embodiment;

FIG. 13 is a diagram illustrating a variable-length code book according to an embodiment;

DETAILED DESCRIPTION OF THE EMBODIMENTS

Figure 1:
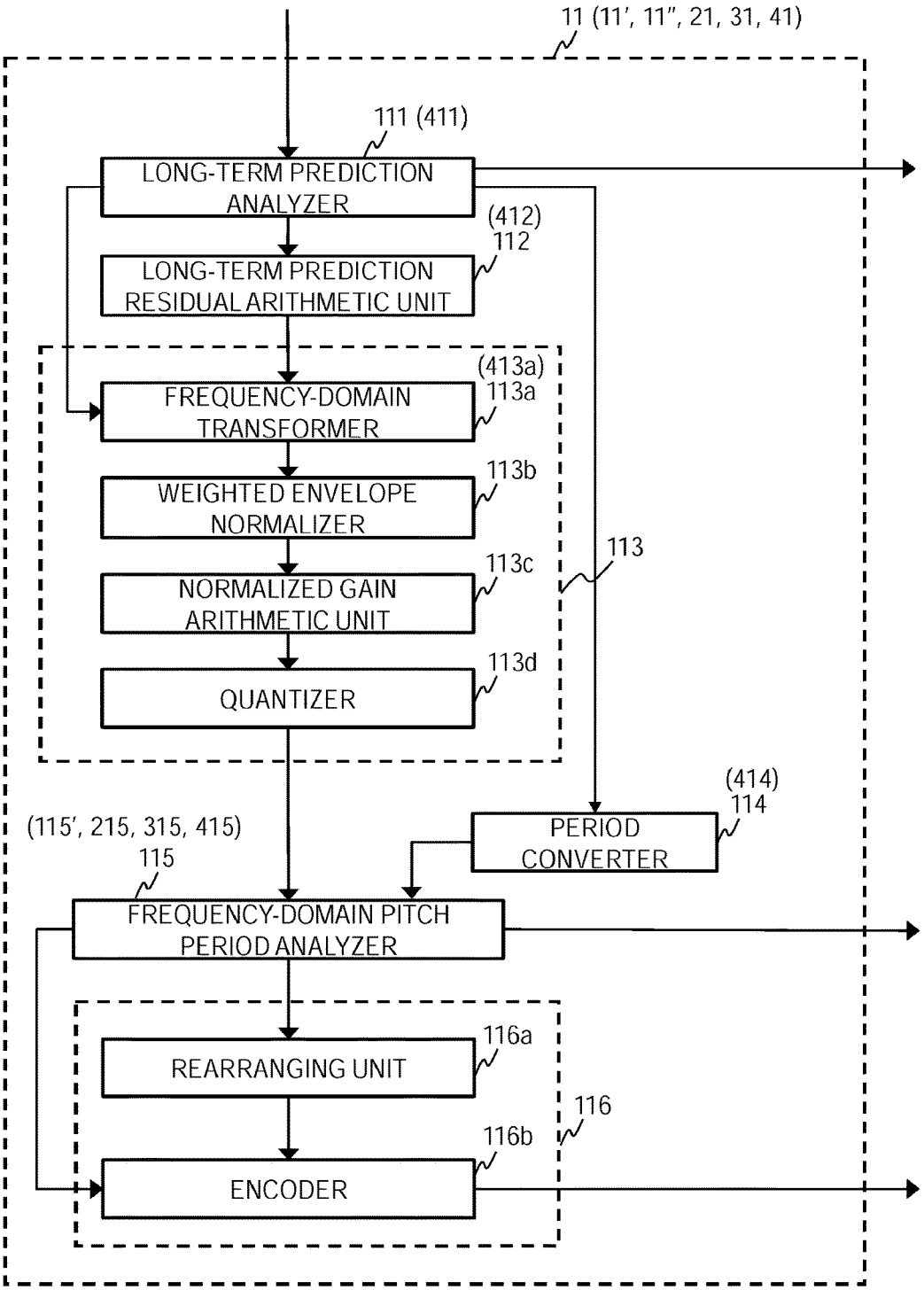
FIG. 1 is a block diagram of an encoder according to an embodiment.

Embodiments of the present invention will be described with reference to drawings. Same elements are given same reference numerals and repeated description of those elements will be omitted.

First Embodiment

Encoder 11

An encoding process performed by an encoder 11 will be described with reference to FIG. 1. Components of the encoder 11 perform operations described below for each frame, which is a given time period. In the following description, the number of samples in a frame is denoted by $N_t$ and one frame of a digital audio signal is a digital audio signal string $x(1), \ldots, x(N_t)$.

Long-Term Prediction Analyzer 111

(Overview)

A long-term prediction analyzer 111 obtains a time-domain pitch period L corresponding to an input digital audio signal string $x(1), \ldots, x(N_t)$ in each frame, which is a given time period (step S111-1), calculates a pitch gain $g_p$ corresponding to the time-domain pitch period L (step S111-2), obtains, on the basis of the pitch gain $g_p$, long-term prediction selection information indicating whether or not long-term prediction is to be performed and outputs the long-term prediction selection information (step S111-3) and, when the long-term prediction selection information indicates that long-term prediction is to be performed, further outputs at least a time-domain pitch period L and a time-domain pitch period code $C_L$ identifying the time-domain pitch period L (step S111-4).

(Step S111-1: Time-Domain Pitch Period L)

The long-term prediction analyzer 111 chooses a time-domain pitch period candidate τ that maximizes the value that can be obtained according to formula (A1) as a time-domain pitch period L corresponding to a digital audio signal string $x(1), \ldots, x(N_t)$ from among predetermined time-domain pitch period candidates τ, for example.

$$\frac{\sum_{t=1}^{N_t} x(t)x(t-\tau)}{\sqrt{\sum_{t=1}^{N_t} x(t-\tau)x(t-\tau)}} \tag{A1}$$

Each candidate τ and the time-domain pitch period L may be represented not only by an integer alone (integer precision) but also represented by an integer and a fractional value (a fraction) (fractional precision). To obtain the value of formula (A1) for a candidate τ of fractional precision, an interpolation filter that applies weighted averaging to a plurality of digital audio signal samples is used to obtain $x(t-\tau)$.

(Step S111-2: Pitch Gain $g_p$)

Based on the digital audio signal and the time-domain pitch period L, for example, the long-term prediction analyzer 111 calculates a pitch gain $g_p$ according to formula (A2).

$$g_p = \frac{\sum_{t=1}^{N_t} x(t)x(t-L)}{\sqrt{\sum_{t=1}^{N_t} x^2(t) \sum_{t=1}^{N_t} x^2(t-L)}} \tag{A2}$$

(Step S111-3: Long-Term Prediction Selection Information)

If the pitch gain $g_p$ is greater than or equal to a predetermined value, the long-term prediction analyzer 111 obtains and outputs long-term prediction selection information indicating that long-term prediction is to be performed; if the pitch gain $g_p$ is smaller than the predetermined value, the long-term prediction analyzer 111 obtains and outputs long-term prediction selection information indicating that long-term prediction is not to be performed.

(Step S111-4: When long-term prediction is performed)

When the long-term prediction selection information indicates that long-term prediction is to be performed, the long-term prediction analyzer 111 performs the following operation.

Predetermined time-domain pitch period candidates τ are stored in the long-term prediction analyzer 111 in association with unique indices assigned to them. The long-term prediction analyzer 111 selects, as the time-domain pitch period code $C_L$ that identifies the time-domain pitch period L, an index that identifies a candidate τ that has been chosen as the time-domain pitch period L.

The long-term prediction analyzer 111 then outputs the time-domain pitch period L and the time-domain pitch period code $C_L$ in addition to the long-term prediction selection information.

If the long-term prediction analyzer 111 also outputs a quantized pitch gain $g_p\hat{}$ and a pitch gain code $C_{gp}$, predetermined pitch gain candidates are stored in the long-term prediction analyzer 111 in association with unique indices assigned to them. The long-term prediction analyzer 111 selects, as the pitch gain code $C_{gp}$ that identifies the quantized pitch gain $g_p\hat{}$, the index that identifies a pitch gain candidate that is closest to the pitch gain $g_p$ from among the pitch gain candidates.

The long-term prediction analyzer 111 then outputs the quantized pitch gain $g_p\hat{}$ and the pitch gain code $C_{gp}$ in addition to the long-term prediction selection information, the time-domain pitch period L and the time-domain pitch period code $C_L$.

Long-Term Prediction Residual Arithmetic Unit 112

When the long-term prediction selection information output from the long-term prediction analyzer 111 indicates that long-term prediction is to be performed, a long-term prediction residual arithmetic unit 112 subtracts a long-term predicted signal from an input digital audio signal string in each frame, which is a given time period, to generate and output a long-term prediction residual signal string. For example, based on an input digital audio signal string $x(1), \ldots, x(N_t)$, a time-domain pitch period L, and a quantized pitch gain $g_p\hat{}$, the long-term prediction residual arithmetic unit 112 calculates a long-term prediction residual signal string $x_p(1), \ldots, x_p(N_t)$ according to formula (A3), thereby generating the long-term prediction residual signal string. If the long-term prediction analyzer 111 does not output a quantized pitch gain $g_p\hat{}$, a predetermined value, such as 0.5, for example, may be used as $g_p\hat{}$.

$$x_p(t)=x(t)-g_p\hat{}x(t-L) \tag{A3}$$

Frequency-Domain Transformer 113*a*

First, when the long-term prediction selection information output from the long-term prediction analyzer 111 indicates that long-term prediction is to be performed, a frequency-domain transformer 113*a* transforms the input long-term prediction residual signal string $x_p(1), \ldots, x_p(N_t)$ to an MDCT coefficient string $X(1), \ldots, X(N)$ at N points in the frequency domain (N is referred to as the "transform frame length") on a frame-by-frame basis; when the long-term prediction selection information output from the long-term prediction analyzer 111 indicates that long-term prediction is not to be performed, the frequency-domain transformer 113*a* transforms the input digital audio signal string $x(1), \ldots, x(N_t)$ to an MDCT coefficient string $X(1), \ldots, X(N)$ at N points in the frequency domain (step S113*a*). The frequency-domain transformer 113*a* performs MDCT transform of a windowed long-term prediction residual signal string or a windowed digital audio signal string at 2*N points in the time domain to obtain coefficients at N points in the frequency domain. Here, the symbol "*" represents multiplication. The frequency-domain transformer 113*a* moves a window in the time domain by N points at a time to update the frame. Samples of adjacent frames overlap at N points each time the window is moved. The shape of the window can be set using the degree of delay or the degree of overlap separately for samples for the long-term predication and samples for the MDCT transform. For example, $N_t$ points may be extracted as samples to be subjected to long-term prediction from a sample portion that does not overlap. If long-term prediction analysis is also applied to overlapping samples, an overlapping process, long-term prediction differences, and the order in which a combining process is applied need to be set so that a significant error does not occur between the encoder and the decoder.

Weighted Envelope Normalizer 113*b*

A weighted envelope normalizer 113*b* normalizes each coefficient in an input MDCT coefficient string with a power spectrum envelope coefficient string of a digital audio signal string estimated using a linear predictive coefficient obtained by linear prediction analysis of the digital audio signal string in each frame and outputs a weighted normalized MDCT coefficient string (step S113*b*). Here, in order to achieve quantization that auditorily minimizes distortion, the weighted envelope normalizer 113*b* uses a weighted power spectral envelope coefficient string obtained by moderating power spectral envelope to normalize the coefficients in the MDCT coefficient strings on a frame-by-frame basis. As a result, the weighted normalized MDCT coefficient string does not have a steep slope of amplitude or large variations in amplitude as compared with the input MDCT coefficient string but has variations in magnitude similar to those of the power spectral envelope coefficient string of the speech/audio digital signal, that is, the weighted normalized MDCT coefficient string has somewhat greater amplitudes in a region of coefficients corresponding to low frequencies and has a fine structure due to a time-domain pitch period.

[Example of Weighted Envelope Normalization Process]

Coefficients $W(1), \ldots, W(N)$ of a power spectral envelope coefficient string that correspond to the coefficients $X(1), \ldots, X(N)$ of an MDCT coefficient string at N points can be obtained by transforming linear predictive coefficients to a frequency domain. For example, according to a p-order autoregressive process, which is an all-pole model, a digital audio signal x(t) at a sample point t corresponding to a time instant can be expressed by formula (1) with past values $x(t-1), \ldots, x(t-p)$ of the signal itself at the past p time points (p is a positive integer), prediction residuals e(t) and linear predictive coefficients $\alpha_1, \ldots, \alpha_p$. Then, the coefficients W(n) [$1 \le n \le N$] of the power spectral envelope coefficient string can be expressed by formula (2), where exp(•) is an exponential function with a base of Napier's constant, j is an imaginary unit, and $\sigma^2$ is prediction residual energy.

$$x(t)+\alpha_1 x(t-1)+\Lambda+\alpha_p x(t-p)=e(t) \tag{1}$$

$$W(n)=\frac{\sigma^2}{2\pi}\frac{1}{|1+\alpha_1\exp(-jn)+\alpha_2\exp(-2jn)+\Lambda+\alpha_p\exp(-pjn)|^2} \tag{2}$$

The linear predictive coefficients may be obtained by linear prediction analysis of the same digital audio signal string that has been input in the long-term prediction analyzer 111 by the weighted envelope normalizer 113*b* or may be obtained by liner prediction analysis of the speech/audio digital signal by other means, not depicted, provided in the encoder 11. In such a case, the weighted envelope normalizer 113*b* uses the linear predictive coefficients to obtain the coefficients $W(1), \ldots, W(N)$ in the power spectrum envelope coefficient string. If the coefficients $W(1), \ldots, W(N)$ in the power spectral envelope coefficient string have been already obtained with other means (the power spectral envelope coefficient string arithmetic unit) in the encoder 11, the weighted envelope normalizer 113*b* can use the coefficients $W(1), \ldots, W(N)$ in the power spectral envelope coefficient string. Note that since a decoder 12, which will be described later, needs to obtain the same values obtained in the encoder 11, quantized linear predictive coefficients and/or power spectral envelope coefficient strings are used. Hereinafter, the term "linear predictive coefficient" or "power spectral envelope coefficient string" means a quantized linear predictive coefficient or a quantized power spectral envelope coefficient string unless otherwise stated. The linear predictive coefficients are encoded by a conventional encoding technique, for example, and the resulting predictive coefficient codes are transmitted to the decoding side. The conventional encoding technique may be an encoding technique that provides codes corresponding to liner predictive coefficients themselves as predictive coefficients codes, an encoding technique that converts linear predictive coefficients to LSP parameters and provides codes corresponding to the LSP parameters as predictive coefficient codes, or an encoding technique that converts liner predictive coefficients to PARCOR coefficients and provides codes corresponding to the PARCOR coefficients as predictive coefficient codes, for example. If power spectral envelope coefficients strings are obtained with other means provided in the encoder 11, other means in the encoder 11 encodes the linear predictive coefficients by a conventional encoding technique and transmits predictive coefficient codes to the decoding side.

While two examples of a weighing envelope normalization process will be given here, the present invention is not limited to the examples.

Example 1

The weighted envelope normalizer 113*b* divides the coefficients X(1), . . . , X(N) in an MDCT coefficient string by correction values $W_\gamma(1), \ldots, W_\gamma(N)$ of the coefficients in a power spectral envelope coefficient string that correspond to the coefficients to obtain the coefficients $X(1)/W_\gamma(1), \ldots, X(N)/W_\gamma(N)$ in a weighted normalized MDCT coefficient string. The correction values $W_\gamma(n)$ $[1 \le n \le N]$ are given by formula (3), where γ is a positive constant less than or equal to 1 and moderates power spectrum coefficients.

$$W_\gamma(n) = \frac{\sigma^2}{2\pi\left(1 + \sum_{i=1}^{p} \alpha_i \gamma^i \exp(-ijn)\right)^2} \tag{3}$$

Example 2

The weighted envelope normalizer 113*b* raises the coefficients in a power spectral envelope coefficient string that correspond to the coefficients X(1), . . . , X(N) in an MDCT coefficient string to the β-th power (0<β<1) and divides the coefficients X(1), . . . , X(N) by the raised values $W(1)^\beta, \ldots, W(N)^\beta$ to obtain the coefficients $X(1)/W(1)^\beta, \ldots, X(N)/W(N)^\beta$ in a weighted normalized MDCT coefficient string.

As a result, a weighted normalized MDCT coefficient string in a frame is obtained. The weighted normalized MDCT coefficient string does not have a steep slope of amplitude or large variations in amplitude as compared with the input MDCT coefficient string but has variations in magnitude similar to those of the power spectral envelope of the input MDCT coefficient string, that is, the weighted normalized MDCT coefficient string has somewhat greater amplitudes in a region of coefficients corresponding to low frequencies and has a fine structure due to a time-domain pitch period.

Note that the inverse process of the weighted envelope normalization process, that is, the process for reconstructing the MDCT coefficient string from the weighted normalized MDCT coefficient string, is performed at the decoding side, settings for the method for calculating weighted power spectral envelope coefficient strings from power spectral envelope coefficient strings need to be common between the encoding and decoding sides.

Normalized Gain Arithmetic Unit 113*c*

Then a normalized gain arithmetic unit 113*c* takes an input of a weighted normalized MDCT coefficient string and determines a quantization step-size by using the sum of amplitude values or energy value over all frequencies so that the coefficients in the weighted normalized MDCT coefficient string in each frame can be quantized by a given total number of bits, and obtains a coefficient (hereinafter referred to as gain) by which the coefficients in the weighted normalized MDCT coefficient string is divided so that the determined quantization step-size is provided (step S113*c*). Information representing the gain is transmitted to the decoding side as gain information. The normalized gain arithmetic unit 113*c* normalizes (divides) the coefficients in the input weighted normalized MDCT coefficient string in each frame by the gain and outputs the normalized coefficients.

Quantizer 113*d*

Then, the quantizer 113*d* uses the quantization step-size determined in the process at step S113*c* to quantize the coefficients in the weighted normalized MDCT coefficient string normalized with the gain on a frame-by-frame basis and outputs the resulting quantized MDCT coefficient string as a "frequency-domain sample string" (step S113*d*).

The quantized MDCT coefficient string (the frequency-domain sample string) in each frame obtained by the process at step S113*d* is input into a frequency-domain pitch period analyzer 115 and a rearranging unit 116*a*.

Period Converter 114

When long-term prediction selection information indicates that long-term prediction is to be performed, a period converter 114 obtains a converted interval $T_1$ based on an input time-domain pitch period L and the number N of sample points in the frequency domain according to formula (A4) and outputs the converted interval $T_1$. "INT( )" in formula (A4) represents a numerical value enclosed in the parentheses reduced to the nearest whole number.

$$T_1 = \mathrm{INT}(N*2/L) \tag{A4}$$

Note that while a theoretical converted interval is N*2/L−½, ½ is added to N*2/L−½ to round to the nearest whole number if it is desirable that the converted interval $T_1$ be an integer value. Alternatively, N*2/L−½ may be rounded to a predetermined decimal place and the resulting value may be set as the converted interval $T_1$. For example, if N*2/L−½ is held in a pseudo binary floating-point format with a five-digit fractional part and an integer pitch period is obtained by rounding, $2^5*(N*2/L-½+½)$ may be rounded down to the nearest integer, the resulting value may be set as the converted interval $T_1$, $T_1$ may be multiplied by an integer, the result may be multiplied by an integer, the result may be multiplied by $½^5=1/32$ to convert it back to the floating-point format, and the resulting value may be set as a candidate to determine a frequency-domain pitch period.

When long-term prediction selection information indicates that long-term prediction is not to be performed, the period converter 114 does nothing. However, the same process may be performed that would be performed when the long-term selection information indicates that long-term prediction is to be performed. That is, the period converter 114 may be configured to take inputs of a time-domain pitch period L and the number N of sample points in the frequency domain and may calculate and output a converted interval $T_1$ without receiving long-term prediction selection information.

Frequency-Domain Pitch Period Analyzer 115

When long-term prediction selection information indicates that long-term prediction is to be performed, a frequency-domain pitch period analyzer 115 chooses a frequency-domain pitch period T from among candidates including an input converted interval $T_1$ and integer multiples $U \times T_1$ of the converted interval $T_1$, and outputs the frequency-domain pitch period T and a frequency-domain pitch period code indicating how many times the frequency-domain pitch period T is greater than the converted interval $T_1$. Here, U is an integer in a predetermined first range. For example, U may be an integer other than 0 and $U \geq 2$, for example. For example, if the integer values in the predetermined first range are greater than or equal to 2 and less than or equal to 8, a total of eight values, namely the converted interval $T_1$ and the values equal to 2 to 8 times the converted interval $T_1$, i.e. $2T_1$, $3T_1$, $4T_1$, $5T_1$, $6T_1$, $7T_1$ and $8T_1$, are frequency-domain pitch period candidates from which a frequency-domain pitch period T is chosen. A frequency-domain pitch period code in this case is a code that is at least 3 bits long and is in one-to-one correspondence with an integer greater than or equal to 1 and less than or equal to 8.

When the long-term prediction selection information indicates that long-term prediction is not to be performed, the frequency-domain pitch period analyzer 115 chooses a frequency-domain pitch period T from among candidates that are integers in a predetermined second range and outputs the frequency-domain pitch period T and a frequency-domain pitch period code indicting the frequency-domain pitch period T. For example if the integers in the predetermined second range are greater than or equal to 5 and less than or equal to 36, a total of $2^5$ values, 5, 6, . . . , 36, are frequency-domain pitch period candidates from which a frequency-domain pitch period T is chosen. A frequency-domain pitch period code in this case is a code that is at least 5 bits long and is in one-to-one correspondence with an integer greater than or equal to 0 and less than or equal to 31.

The frequency-domain pitch period analyzer 115 chooses a candidate that maximizes an indicator of the degree of concentration of energy on a sample group selected according to a predetermined rearranging rule, for example, as the frequency-domain pitch period T. The indicator of the degree of concentration of energy may be the sum of energy or the sum of absolute values. If the indicator of the degree of concentration of energy is the sum of energy, a candidate that maximizes the sum of energy of all samples included in a sample group selected according to a predetermined rearranging rule is chosen as the frequency-domain pitch period T. If the indicator of the degree of concentration of energy is the sum of absolute values, a candidate that maximizes the sum of the absolute values of all samples included in a sample group selected according to a predetermined rearranging rule is chosen as the frequency-domain pitch period T. A "sample group selected according to a predetermined rearranging rule" will be described later in detail in the section on the rearranging unit 116*a*.

Alternatively, for example the frequency-domain pitch period analyzer 115 may actually encode a sample string rearranged according to a predetermined rule and may choose a candidate that minimizes the code amount as the frequency-domain pitch period T. A "sample string rearranged according to a predetermined rule" will be described later in detail in the section on the rearranging unit 116*a*.

Alternatively, the frequency-domain pitch period analyzer 115 may choose, for example, a predetermined number of candidates that yield the largest indicators of the degrees of concentration of energy on a sample group selected according to a predetermined rearranging rule, may actually encode a sample string of the chosen candidates rearranged according to the predetermined rule, and may choose a candidate that minimizes the code amount as the frequency-domain pitch period T.

The meaning of choosing a frequency-domain pitch period T from among candidates that are a converted interval $T_1$ and integer multiples $U \times T_1$ of the converted interval $T_1$ by the frequency-domain pitch period analyzer 115 when long-term prediction selection information indicates that long-term prediction is to be performed will be described below.

Let a windowed long-term prediction residual signal string at 2*N points in the time domain be $x_p'(1), \ldots, x_p'(2*N)$, then MDCT transform of the signal string $x_p'(1), \ldots, x_p'(2*N)$ yields the following MDCT coefficient string X(1), . . . , X(N), for example:

$$X(k) = \rho \sum_{n=1}^{2*N} x_p'(n) \cos\left\{\frac{(2*n-1+N)(2*k-1)\pi}{4*N}\right\} \tag{4}$$

where, ρ is a coefficient such as $(1/N)^{1/2}$ and k is an index k=1, . . . , N that corresponds to a frequency. That is, each MDCT coefficient string X(k) is the inner product of the following 2*N-dimensional orthonormal basis vector B(k) and a signal string vector $(x_p'(1), \ldots, x_p'(2*N))$, for example.

$$B(k) = \left(\rho * \cos\left\{\frac{(1+N)(2*k-1)\pi}{4*N}\right\}, \ldots, \rho * \cos\left\{\frac{(5*N-1)(2*k-1)\pi}{4*N}\right\}\right)$$

Ideally, the signal string $x_p'(1), \ldots, x_p'(2*N)$ has a fundamental periodicity $P_f$ (the fundamental period of the digital audio signal string $x(1), \ldots, x(N_t)$) in the time domain, therefore a string consisting of each inner product given above, i.e. the energy or absolute value of each MDCT coefficient X(k) is maximized at frequency intervals of $2*N/P_f$ (hereinafter referred to as "ideal converted intervals") (except for a special case such as where the signal string $x_p'(1), \ldots, x_p'(2*N)$ is a sinusoidal wave). Accordingly, the time-domain pitch period L chosen at step S111-1 is ideally the fundamental period $P_f$ and the ideal converted interval $2*N/P_f$ where $P_f$=L is the frequency-domain pitch period T.

However, $x(1), \ldots, x(N_t)$ and X(1), . . . , X(N) are discrete values. Not all integer multiples of a neighboring sample interval of X(1), . . . , X(N) in the time domain are the fundamental period $P_f$. In addition, integer multiples of a neighboring sample interval of X(1), . . . , X(N) in the frequency domain are not always the ideal converted intervals $2*N/P_f$. Accordingly, in some cases the time-domain pitch period L chosen at step S111-1 can be an integer multiple of the fundamental period $P_f$ or a candidate τ close to an integer multiple of the fundamental period $P_f$ rather than the fundamental period $P_f$ or a candidate τ close to the fundamental period $P_f$. If the time-domain pitch period L is an integer multiple $n*P_f$ of the fundamental period, the frequency-domain interval $T_1'$ transformed from the time-domain pitch period L will be equal to the ideal converted interval multiplied by a fraction of an integer, i.e. $(2*N/P_f)/n$. Consequently, there may cases where a sample group cannot be selected with the frequency-domain pitch period T that is equal to the ideal converted intervals $2*N/P_f$ but a sample group can be selected with a frequency-domain pitch period T that is equal to an integer multiple of the interval $T_1'=2*N/L$ to increase the indicator of the degree of concentration of energy on the selected sample group. These will cases be described with an example.

Figure 3:
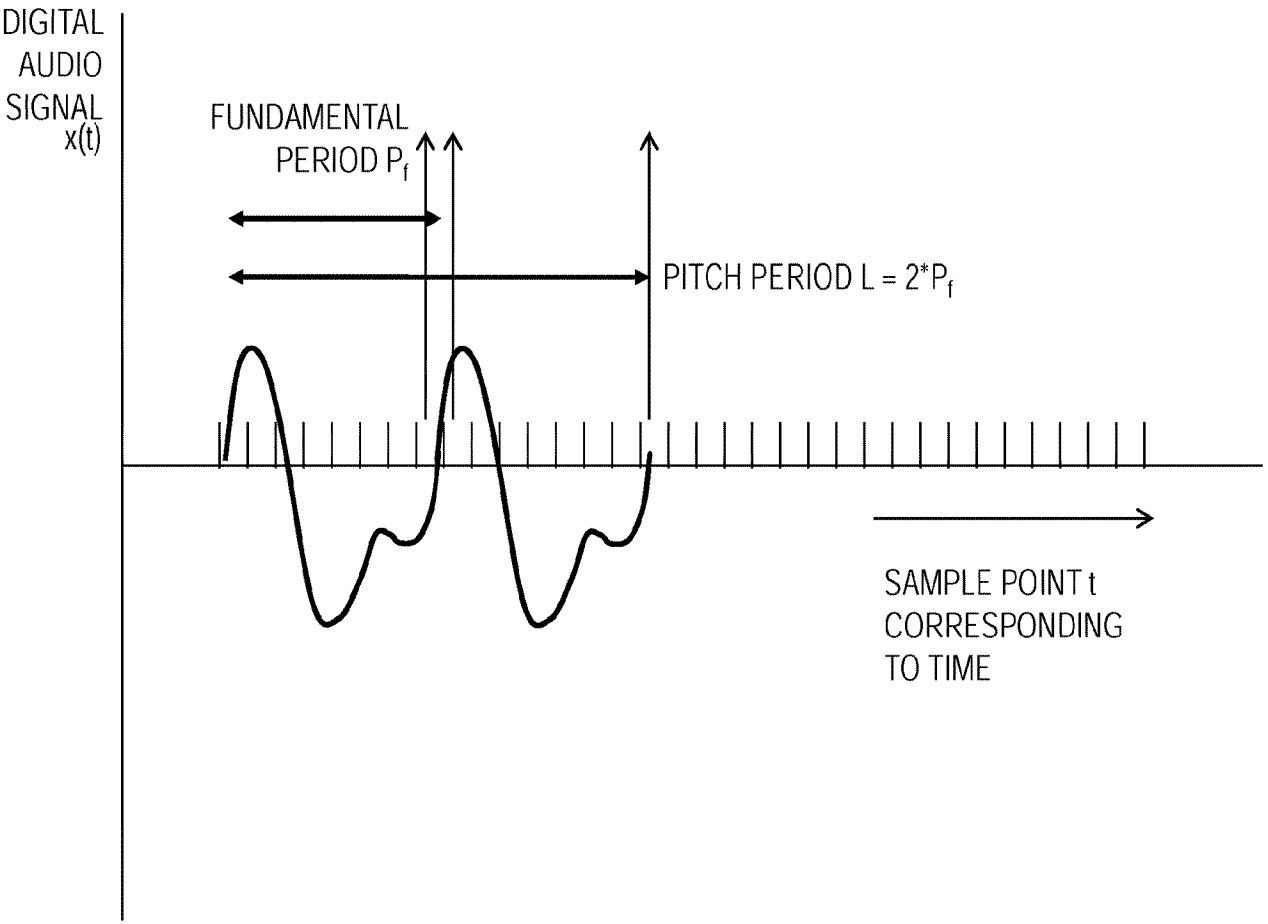
FIG. 3 is a diagram illustrating the relationship among fundamental frequency in the time domain, time-domain pitch period and sample points.

As has been described previously, the time-domain pitch period L chosen at step S111-1 is a candidate τ that can maximize a value that can be obtained according to formula (A1). In general, x(t)x(t−z) in formula (A1) is maximized when a candidate τ that is closest to any one of the fundamental period $P_f$ of the digital audio signal string $x(1), \ldots, x(N_t)$ or integer multiples of the fundamental period $P_f$, i.e. $n*P_f$ (where n is a positive integer) is chosen. That is, a candidate τ that is closest to any of $n*P_f$ is more likely to be the time-domain pitch period L. Here, when the fundamental period $P_f$ is an integer multiple of the sampling period (the interval between neighboring samples) of the digital audio signal string $x(1), \ldots, x(N_t)$, the fundamental period $P_f$ or a candidate τ that is closest to the fundamental period $P_f$ is likely to maximize the value that can be obtained according to formula (A1) and is likely to be the time-domain pitch period L. On the other hand, when the fundamental period $P_f$ is not an integer multiple of the sampling period, $n*P_f$ that is not equal to the fundamental period $P_f$ or a candidate τ that is closest to such $n*P_f$ is more likely to maximize the value that can be obtained according to formula (A1) and is likely to be the time-domain pitch period L. For example, in the example in FIG. 3, the fundamental period $P_f$ is not an integer multiple of the sampling period and the $2*P_f$ is chosen as the time-domain pitch period L. If there are multiple candidates that are integer multiples of the sampling period among candidates z for the time-domain pitch period, a candidate having a smaller value yields a larger value of formula A1 and is therefore more likely to be chosen as the time-domain pitch period L. For example, if $2*P_f$ and $4*P_f$ are integer multiples of the sampling period, $2*P_f$ is more likely to be chosen as the time-domain pitch period L because $2*P_f$ yields a larger value of formula (A1). That is, a smaller value of n given above is more likely to be used.

In other words, the time-domain pitch period L chosen at step S111-1 can be approximated as $L=n*P_f$. Therefore, the frequency-domain interval $T_1'=2*N/L$ converted from the time-domain pitch period L can be approximated as:

$$T_1'=2*N/L=2*N/n*P_f=(2*N/P_f)/n \quad \text{(A41)}$$

In other words, the interval $T_1'$ can be approximated by 1/n times the ideal converted interval $(2*N/P_f)$. In this case, an integer multiple of the interval $n*T_1'$, rather than the interval $T_1'$, corresponds to the ideal converted interval $2*N/P_f$.

Figure 4:
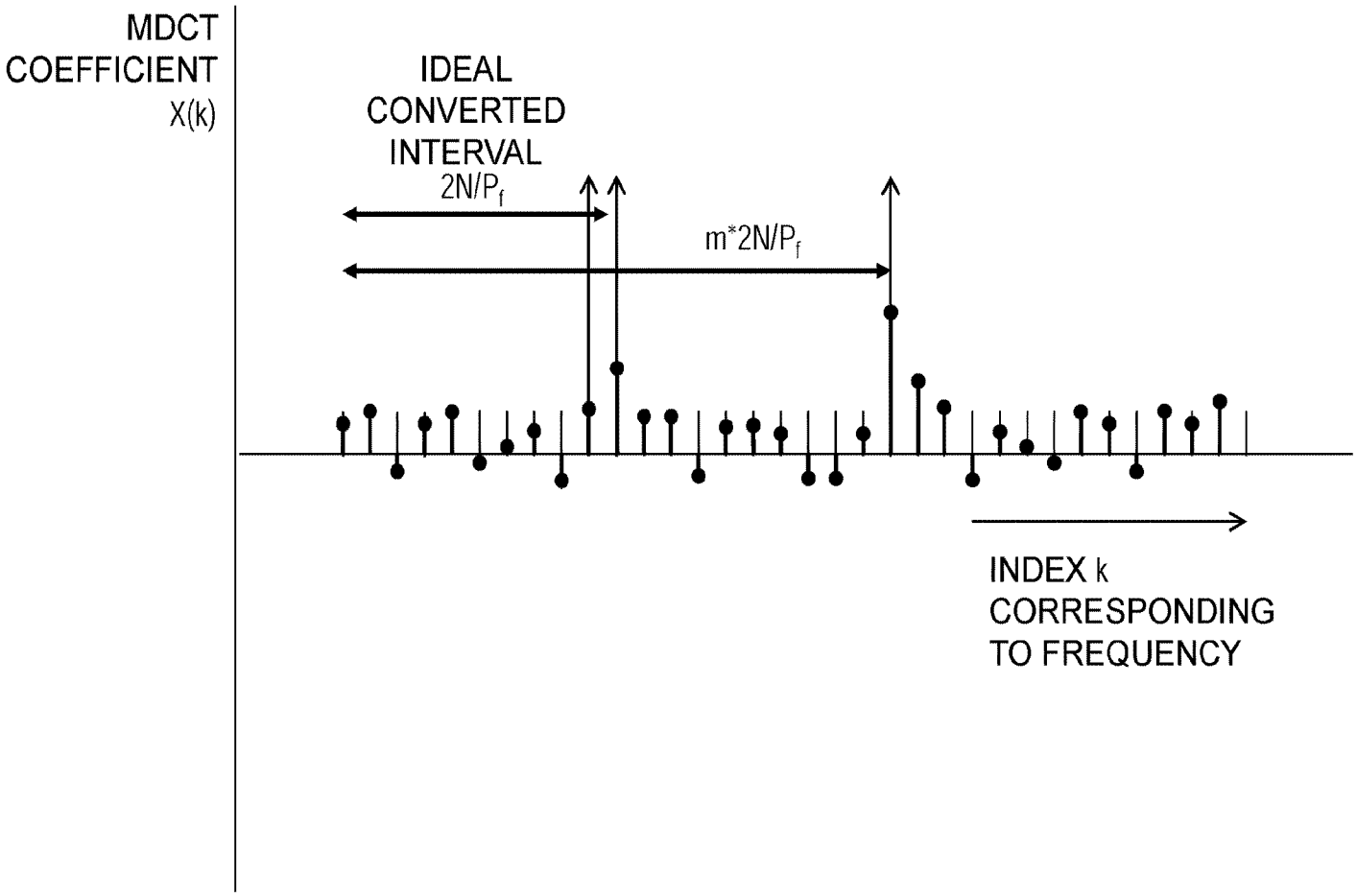
FIG. 4 is a diagram illustrating the relationship among an ideal converted interval in the frequency domain, an interval equal to the converted interval multiplied by m, and frequency.

Furthermore, an integer multiple of the sampling interval in the frequency domain is not always corresponds to the ideal converted interval $2*N/P_f$. For example, in the example in FIG. 4, since the ideal converted interval $2*N/P_f$ is not an integer multiple of a neighboring sampling period of the MDCT coefficient string $X(1), \ldots, X(N)$, a sample group cannot be selected with the ideal converted interval $2*N/P_f$ that is equal to the frequency-domain pitch period T. However, in terms of increasing the degree of concentration of energy on a sample group selected based on a frequency domain pitch period, a frequency-domain pitch period $T=m*2*N/P_f$ that is m times (where m is a positive integer) greater than an idea converted interval $2*N/P_f$ can be chosen to increase the indicator of the degree of concentration of energy on the selected sample group even if the ideal converted interval $2*N/P_f$ itself cannot be chosen as the frequency-domain pitch period. That is, for the purpose of increasing the degree of concentration of energy on a selected sample group, the relationship between frequency-domain pitch period T and converted interval $T_1'$ can be written from formula (A41) as follows:

$$T=m*(2*N/P_f)=m*n*T_1' \quad \text{(A42)}$$

Further, by using converted interval $T_1$ in formula (A4), formula (A42) can be approximated as follows:

$$T=m*n*\mathrm{INT}(T_1')=m*n*\mathrm{INT}(2*N/L)=m*n*T_1 \quad \text{(A43)}$$

That is, frequency-domain pitch period T can be approximated by an integer multiple of converted interval $T_1$. In other words, an integer multiple of converted interval $T_1$ is more likely to be a frequency-domain pitch period T that provides a larger indicator of the degree of concentration of energy on a sample group than other values. That is, a large indicator of the degree of concentration of energy on a sample group can be provided by choosing a frequency-domain pitch period T from candidates that are the converted interval $T_1$, integer multiples of the converted interval $T_1$ and values close to these values.

Since a smaller value of n is more likely to be used as described above and m is a positive integer, in the frequency domain a smaller multiplier m*n for converted interval $T_1$ of frequency-domain pitch period T is more likely to be chosen as the frequency-domain pitch period T. That is, a smaller integer multiple of converted interval $T_1$ is likely to be chosen as the frequency-domain pitch period T.

Figure 5:
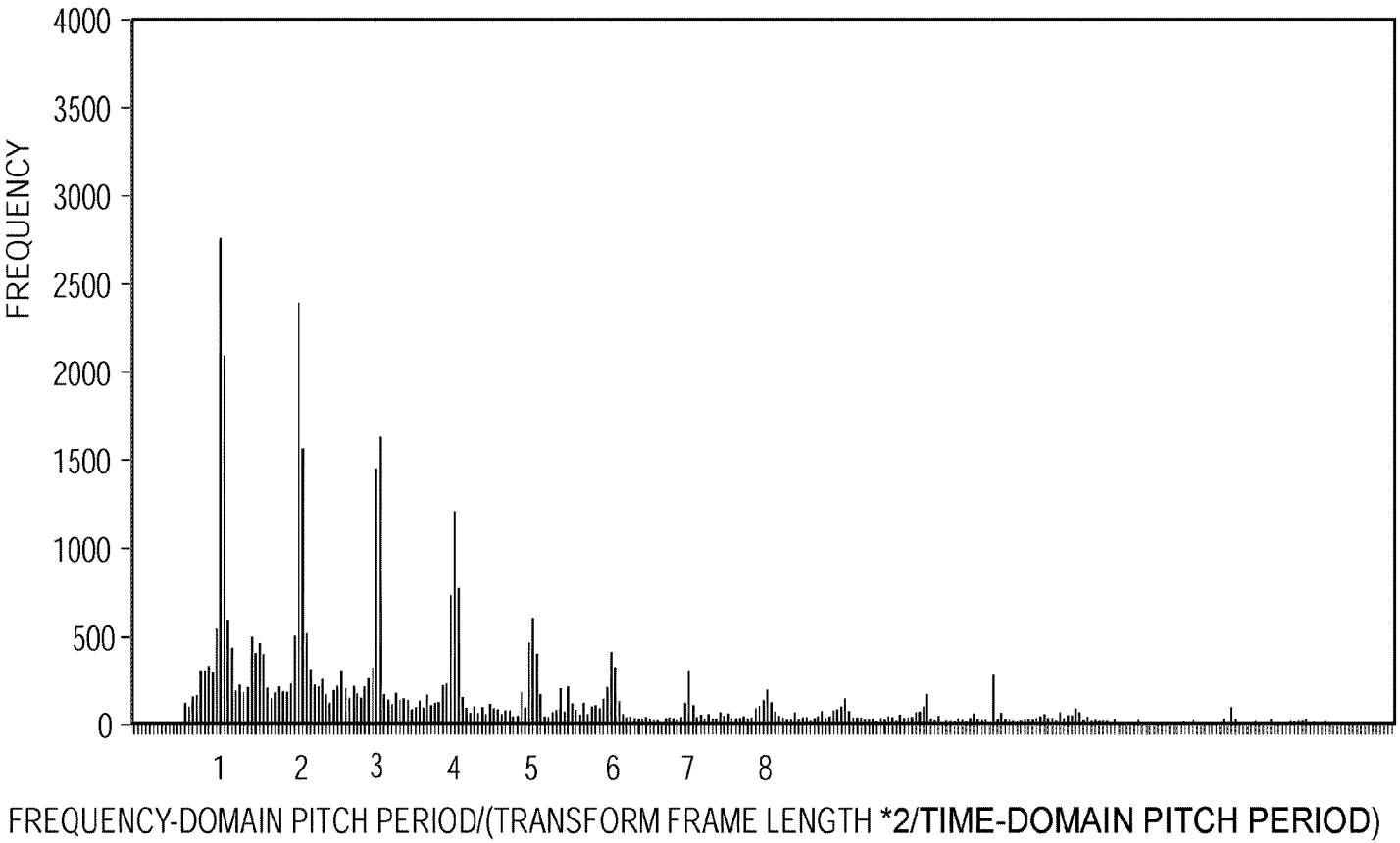
FIG. 5 is a diagram illustrating the frequency of frequency-domain pitch period/(transform frame length*2/time-domain pitch period)

FIG. 5 illustrates a graph in which the horizontal axis represents frequency-domain pitch period/(transform frame length*2/time-domain pitch period) $(T/(2*N/L)=T/T_1)$ and the vertical axis represents its frequency. FIG. 5 illustrates the relationship between frequency-domain pitch period and time-domain pitch period that provides a large indicator of the degree of concentration of energy on a sample group. It can be seen from FIG. 5 that the frequency-domain pitch period T more frequently occurs as an integer multiple (especially 1-, 2-, 3- or 4-fold) of converted interval $T_1$ or a value close to an integer multiple of converted interval $T_1$ and the frequency-domain pitch period T less frequently occurs as a value other than integer multiples of converted interval $T_1$. In other words, FIG. 5 indicates that a frequency-domain pitch period T that provides a large degree of concentration of energy on a sample group is highly likely to be an integer multiple of the converted interval $T_1$ or a value close to an integer multiple of the converted interval $T_1$. It also can be seen that a smaller multiplier m*n for the converted interval $T_1$ of frequency-domain pitch period T is more likely to be chosen as the frequency-domain pitch period T. Accordingly, a value that provides a large degree of concentration of energy on a sample group can be found as the frequency-domain pitch period from among candidates that are integer multiples of converted interval $T_1$ and values close to them.

Frequency-Domain-Pitch-Period-Based Encoder 116

A frequency-domain-pitch-period-based encoder 116 includes a rearranging unit **116*a* and an encoder 116*b***, encodes an input frequency-domain sample string by an encoding method based on a frequency-domain pitch period T and outputs a resulting code string.

Rearranging Unit 116*a*

The rearranging unit 116*a* rearranges at least some of the samples included in a sample string so that (1) all of the samples in the frequency-domain sample string are included and (2) all or some of one or a plurality of successive samples including a sample corresponding to a frequency-domain pitch period T chosen by the frequency-domain pitch period analyzer 115 in the frequency-domain sample string and one or a plurality of successive samples including a sample corresponding to an integer multiple of the frequency-domain pitch period T in the frequency-domain sample string are gathered together in a cluster, and outputs the rearranged sample string. That is, at least some of the samples included in an input sample string are rearranged so that one or a plurality of successive samples including a sample corresponding to a frequency-domain pitch period T and one or a plurality of successive samples including a sample corresponding to an integer multiple of the frequency-domain pitch period T are gathered together.

One or a plurality of successive samples including the sample corresponding to the frequency-domain pitch period T and one or a plurality of successive samples including samples corresponding to an integer multiple of the frequency-domain pitch period T are gathered together into one cluster at a low frequency side.

By way of example, the rearranging unit 116*a* selects three samples, namely a sample F(nT) corresponding to an integer multiple of the frequency-domain pitch period T, the sample preceding the sample F(nT) and the sample succeeding the sample F(nT), F(nT−1), F(nT) and F(nT+1), from an input sample string. The group of the selected samples is a "sample group selected according to a predetermined rearranging rule" in the frequency-domain pitch period analyzer 115. F(j) is a sample corresponding to an identification number j representing a sample index corresponding to a frequency. Here, n is an integer in the range from 1 to a value such that nT+1 does not exceed a predetermined upper bound N of samples to be rearranged. The maximum value of the identification number j representing a sample index corresponding to a frequency is denoted by jmax. A set of samples selected according to n is referred to as a sample group. The upper bound N may be equal to jmax. However, N may be smaller than jmax in order to gather samples having great indicators together in a cluster at the lower frequency side to improve the efficiency of encoding as will be described later, because indicators of samples in a high frequency band of an audio signal such as speech and music are typically sufficiently small. For example, N may be about a half the value of jmax. Let nmax denote the maximum value of n that is determined based on the upper bound N, then samples corresponding to frequencies in the range from the lowest frequency to a first predetermined frequency nmax*T+1 among the samples in an input sample string are the samples to be rearranged. Here, the symbol * represents multiplication.

The rearranging unit 116*a* arranges the selected samples F(j) in order from the beginning of the sample string while maintaining the original sequence of the identification numbers j to generate a sample string A. For example, if n represents an integer in the range from 1 to 5, the rearranging unit 116*a* arranges a first sample group F(T−1), F(T) and F(T+1), a second sample group F(2T−1), F(2T) and F(2T+1), a third sample group F(3T−1), F(3T) and F(3−1), a fourth sample group F(4T−1), F(4) and F(4+1), and a fifth sample group F(5T−1), F(5T) and F(5T+1) in order from the beginning of the sample string. That is, 15 samples F(T−1), F(T), F(T+1), F(2T−1), F(2T), F(2T+1), F(3T−1), F(3T), F(3T+1), F(4T−1), F(4T), F(4T+1), F(5T−1), F(5T) and F(5T+1) are arranged in this order from the beginning of the sample string and the 15 samples make up sample string A.

The rearranging unit 116*a* further arranges samples F(j) that have not been selected in order from the end of sample string A while maintaining the original sequence of the identification numbers. The samples F(j) that have not been selected are located between the sample groups that make up sample string A. A cluster of such successive samples is referred to as a sample set. That is, in the example described above, a first sample set F(1), . . . , F(T−2), a second sample set F(T+2), . . . , F(2T−2), a third sample set F(2T+2), . . . , F(3T−2), a fourth sample set F(3T+2), . . . , F(4T−2), a fifth sample set F(4T+2), . . . , F(5T−2), and a sixth sample set F(5T+2), . . . , F(jmax) are arranged in order from the end of sample string A and these samples make up sample string B.

Figure 6:
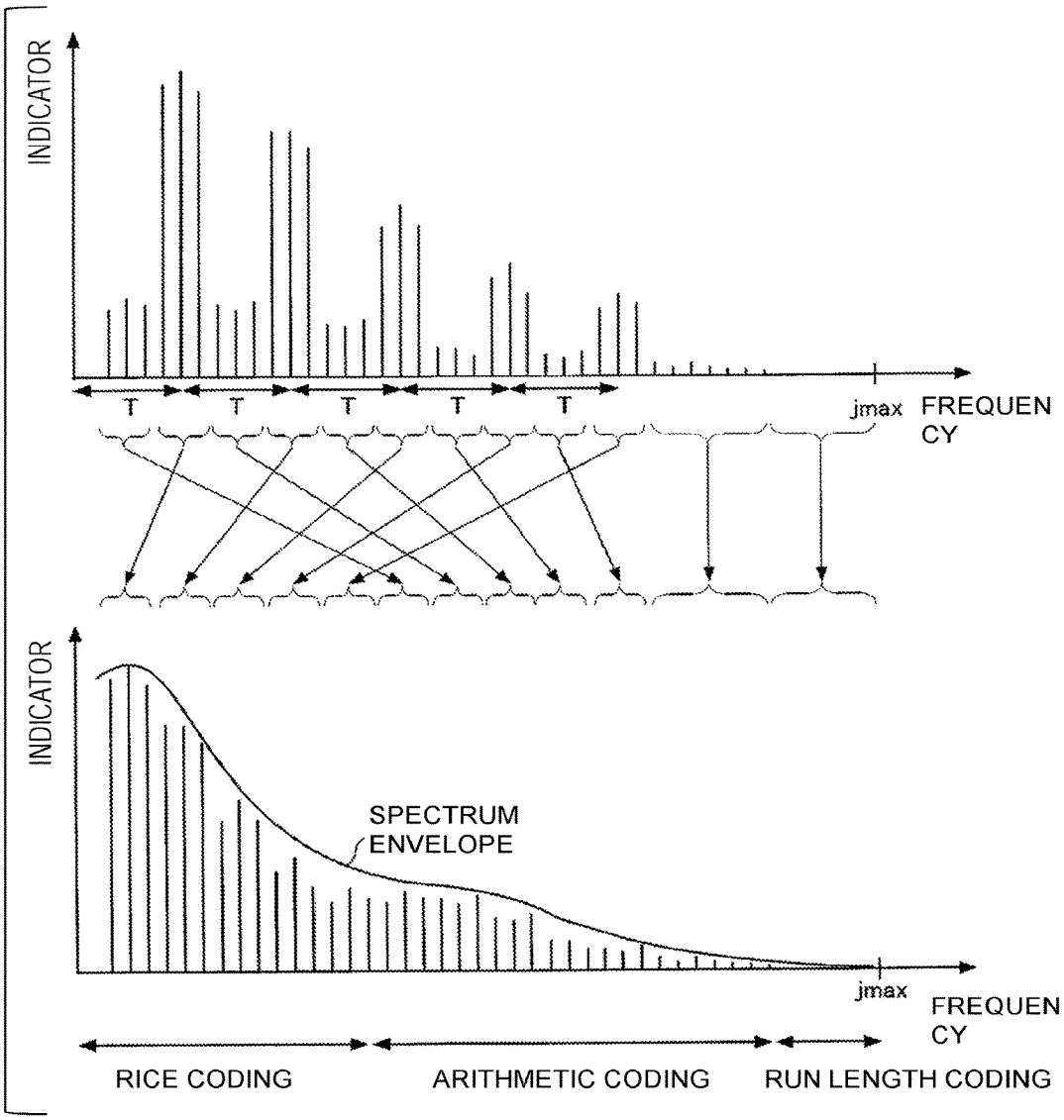
FIG. 6 is a conceptual diagram illustrating an example of rearranging of samples included in a sample string.

In short, an input sample string F(j) (1≤j≤jmax) in this example is rearranged as F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), . . . , F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) (see FIG. 6). The rearranged sample string is a "sample string rearranged in accordance with a predetermined rearranging rule" in the frequency-domain pitch period analyzer 115.

Note that in a low frequency band, samples other than samples corresponding to a frequency-domain pitch period T and samples corresponding to integer multiples of the frequency-domain pitch period T often have great amplitudes and power values. Therefore, samples in a range from the lowest frequency to a predetermined frequency f may be excluded from rearranging. For example, if the predetermined frequency f is nT+α, original samples F(1), . . . , F(nT+α) are not rearranged but original samples F(nT+α−1) and the subsequent samples are rearranged, where a is preset to an integer greater than or equal to 0 and somewhat less than T (for example an integer less than T/2). Here, n may be an integer greater than or equal to 2. Alternatively, original P successive samples F(1), . . . , F(P) from a sample corresponding to the lowest frequency may be excluded from rearranging and original sample F(P+1) and the subsequent samples may be rearranged. In this case, the predetermined frequency f is P. A collection of samples to be rearranged are rearranged according to the rule described above. Note that if a first predetermined frequency has been set, the predetermined frequency f (a second predetermined frequency) is lower than the first predetermined frequency.

If original samples F(1), . . . , F(T+1), for example, are not rearranged and an original sample F(T+2) and the subsequent samples are to be rearranged, the input sample string F(j) (1≤j≤jmax) will be rearranged as F(1), . . . , F(T+1), F(2T−1), F(2T), F(2T+1), F(3T−1), F(3T), F(3T+1), F(4T−1), F(4T), F(4T+1), F(5T−1), F(5T), F(5T+1), F(T+2), . . . , F(2T−2), F(2T+2), . . . , F(3T−2), F(3T+2), . . . , F(4T−2), F(4T+2), . . . , F(5T−2), F(5T+2), . . . , F(jmax) according to the rearranging rule described above (see FIG. 7).

Different upper bounds N or different first predetermined frequencies which determine the maximum value of identification numbers j to be rearranged may be set for different frames, rather than setting an upper bound N or first predetermined frequency that is common to all frames. In that case, information specifying an upper bound N or a first predetermined frequency for each frame may be transmitted to the decoding side. Furthermore, the number of sample groups to be rearranged may be specified instead of specifying the maximum value of identification numbers j to be rearranged. In that case, the number of sample groups may be set for each frame and information specifying the number of sample groups may be transmitted to the decoding side. Of course, the number of sample groups to be rearranged may be common to all frames. Different second predetermined frequencies f may be set for different frames, instead of setting a second predetermined value that is common to all frames. In that case, information specifying a second predetermine frequency for each frame may be transmitted to the decoding side.

Figure 7:
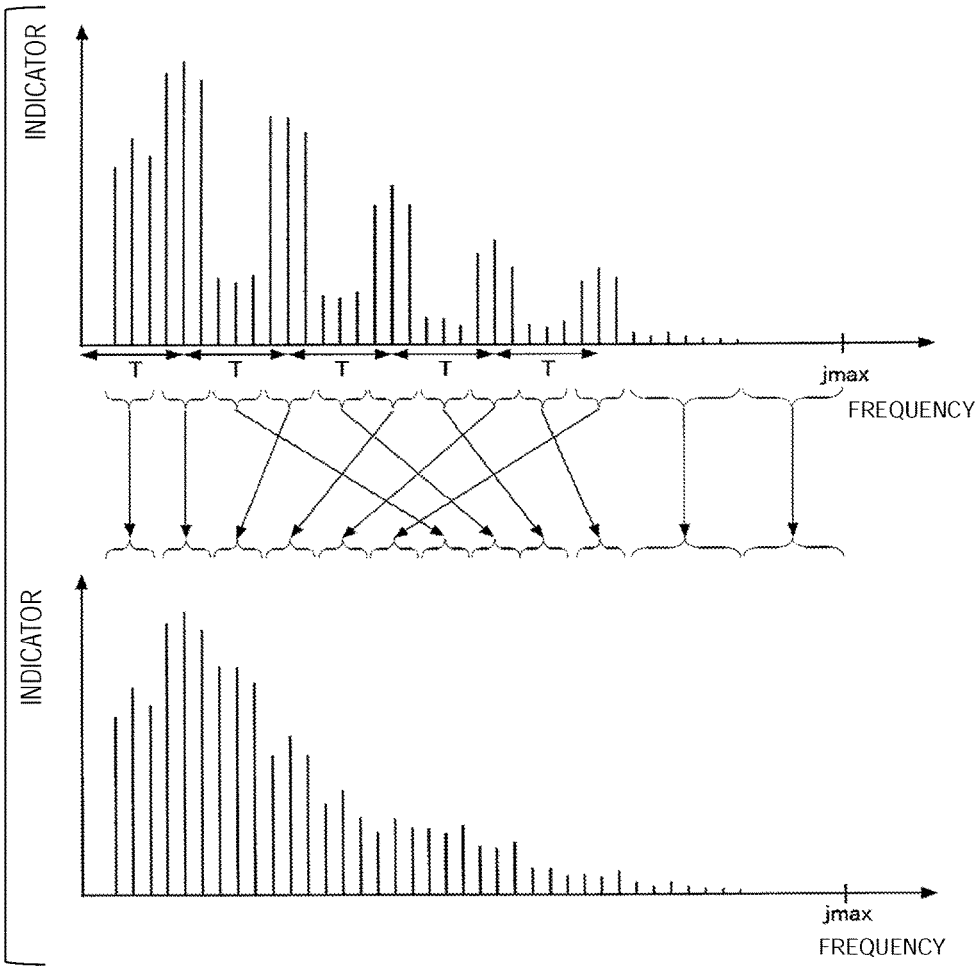
FIG. 7 is a conceptual diagram illustrating an example of rearranging of samples included in a sample string.

The envelope of indicators of the samples in the sample string thus rearranged declines with increasing frequency when frequencies and the indicators of the samples are plotted as abscissae and ordinates, respectively. The reason is the fact that audio signal sample strings, especially speech and music signals sample strings in the frequency domain generally contain fewer high-frequency components. In other words, the rearranging unit 116*a* rearranges at least some of the samples contained in the input sample string so that the envelope of indicators of the samples declines with increasing frequency. Note that FIGS. 6 and 7 illustrate examples in which all of the samples included in a sample string in the frequency domain are positive values in order to clearly show that samples that have greater amplitudes appear at the lower frequency side as a result of rearranging of the samples. In practice, the samples included in a sample string in the frequency domain are often positive or negative or zero. The rearranging described above or a rearranging process which will be described later may be performed in such cases as well.

While the rearranging in this embodiment gathers one or a plurality of successive samples including a sample corresponding to the frequency-domain pitch period T and one or a plurality of successive samples including a sample corresponding to an integer multiple of the frequency-domain pitch period T together into one cluster at the low frequency side, rearranging may be performed that gathers one or a plurality of successive samples including a sample corresponding to the frequency-domain pitch period T and one or a plurality of successive samples including samples corresponding to an integer multiple of the frequency-domain pitch period T together into one cluster at the high frequency side. In that case, sample groups in sample string A are arranged in the reverse order, sample sets in sample string B are arranged in the reverse order, sample string B is placed at the low frequency side, sample string A follows sample string B. That is, the samples in the example described above are arranged in the following order from the low frequency side: the sixth sample set F(5T+2), . . . , F(jmax), the fifth sample set F(4T+2), . . . , F(5T−2), the fourth sample set F(3T+2), . . . , F(4T−2), the third sample set F(2T+2), . . . , F(3T−2), the second sample set F(T+2), . . . , F(2T−2), the first sample set F(1), . . . , F(T−2), the fifth sample group F(5T−1), F(5T), F(5T+1), the fourth sample group F(4T−1), F(4T), F(4T+1), the third sample group F(3T−1), F(3T), F(3T+1), the second sample group F(2T−1), F(2T), F(2T+1), and the first sample group F(T−1), F(T), F(T+1). The envelope of indicators of the samples in the sample string thus rearranged rises with increasing frequency when frequencies and the indicators of samples are plotted as abscissae and ordinates, respectively. In other words, the rearranging unit 116*a* rearranges at least some of the samples included in the input sample string so that the envelope of the samples rises with increasing frequency.

The frequency-domain pitch period T may be a fractional value instead of an integer. In that case, F(R(nT−1)), F(R(nT)), and F(R(nT+1)), for example, are selected, where R(nT) represents a value nT rounded to the nearest integer.

Note that if the frequency-domain pitch period analyzer 115 performs the process for choosing a candidate that minimizes the actual code amount as the frequency-domain pitch period T, the frequency-domain-pitch-period-based encoder 116 does not need to include the rearranging unit 116*a* because the frequency-domain pitch period analyzer 115 generates a rearranged sample string.

[The Number of Samples Collected]

An example is given in this embodiment where the number of samples included in each sample group is fixed to three, namely a sample corresponding to a frequency-domain pitch period T or an integer multiple of the frequency-domain pitch period T (hereinafter the sample referred to as center sample), the sample preceding the center sample, and the sample succeeding the center sample. However, if the number of samples in a sample group and sample indices are variable, the rearranging unit 116*a* outputs information indicating one selected from a plurality of alternatives in which combinations of the number of samples in a sample group and sample indices are different as auxiliary information (first auxiliary information).

For example, if (1) center sample only, F(nT), (2) a total of three samples, namely a center sample, the sample preceding the center sample and the sample succeeding the center sample, F(nT−1), F(nT), F(nT+1), (3) a total of three samples, namely a center sample and the two preceding samples, F(nT−2), F(nT−1), F(nT), (4) a total of four samples, namely a center sample and the three preceding samples, F(nT−3), F(nT−2), F(nT−1), F(nT), (5) a total of three samples, namely a center sample and the two succeeding samples, F(nT), F(nT+1), F(nT+2), and (6) a total of four samples, namely a center sample and the three succeeding samples, F(nT), F(nT+1), F(nT+2), F(nT+3)

are set as alternatives and (4) is selected, information indicating that (4) has been selected is output as first auxiliary information. Three bits is enough for information indicating the selected alternative in this example.

One method for choosing one of the alternatives is as follows. The rearranging unit 116*a* may perform rearranging corresponding to each of these alternatives and the encoder 116*b*, which will be described below, may obtain the code amount of a code string corresponding to each of the alternatives. Then, the alternative that yields the smallest code amount may be selected. In this case, the first auxiliary information is output from the encoder 116*b* instead of the rearranging unit 116*a*. This method is also applied to a case where n can be selected from a plurality of alternatives.

Encoder 116*b*

Then the encoder 116*b* encodes the sample string output from the rearranging unit 116*a* and outputs the resulting code string (step S116*b*). For example, the encoder 116*b* changes variable-length encoding according to the localization of the amplitudes of samples included in the sample string output from the rearranging unit 116*a* and encodes the sample string. That is, since samples having great amplitudes are gathered together in a cluster at the low (or high) frequency side in a frame by the rearranging unit 116*a*, the encoder 116*b* performs variable-length encoding appropriate for the localization. If samples having equal or nearly equal amplitudes are gathered together in a cluster in each local region like the sample string output from the rearranging unit 116*a*, the average code amount can be reduced by, for example, Rice coding using different Rice parameters for different regions. An example will be described in which samples having great amplitudes are gathered together in a cluster at the low frequency side in a frame (the side closer to the beginning of the frame).

[Example of Encoding]

By way of example, the encoder 116*b* applies Rice coding (also called Golomb-Rice coding) to each sample in a region where samples having great amplitudes are gathered together in a cluster. In a region other than this region, the encoder 116*b* applies entropy coding (such as Huffman coding or arithmetic coding), which is also suitable for a set of samples gathered together. For applying Rice coding, a Rice parameter and a region to which Rice coding is applied may be fixed or a plurality of different combinations of region to which Rice coding is applied and Rice parameter may be provided so that one combination can be chosen from the combinations. When one of the plurality of combinations is chosen, the following variable-length codes (binary values enclosed in quotation marks " "), for example, can be used as selection information indicating the choice for Rice coding and the encoder 116*b* outputs the selection information indicating the choice.

"1": Rice coding is not applied.

"01": Rice coding is applied to the first 1/32 region of a string with Rice parameter 1.

"001": Rice coding is applied to the first 1/32 region of a string with Rice parameter 2.

"0001": Rice coding is applied to the first 1/16 region of a string with Rice parameter 1.

"00001": Rice coding is applied to the first 1/16 region of a string with Rice parameter 2.

"00000": Rice coding is applied to the first 1/32 region of a string with Rice parameter 3.

A method for choosing one of these alternatives may be to compare the code amounts of code strings corresponding to different alternatives for Rice coding that are obtained by encoding to choose an alternative with the smallest code amount.

When a region where samples having an amplitude of 0 occur in a long succession appears in a rearranged sample string, the average code amount can be reduced by run length coding, for example, of the number of the successive samples having an amplitude of 0. In such a case, the encoder 116*b* (1) applies Rice coding to each sample in the region where the samples having great amplitudes are gathered together in a cluster and, (2) in the regions other than that region, (a) applies encoding that outputs codes that represents the number of successive samples having an amplitude of 0 to a region where samples having an amplitude of 0 appear in succession, (b) applies entropy coding (such as Huffman coding or arithmetic coding), which is also suitable for a set of samples gathered together, to the remaining regions. Again, a choice can be made among Rice coding alternatives described above. In this case, information indicating regions where run length coding has been applied needs to be sent to the decoding side. This information may be included in the selection information described above, for example. Additionally, if a plurality of types of entropy coding methods are provided as alternatives, information identifying which of the types of encoding has been chosen needs to be sent to the decoding side. The information may be included in the selection information described above, for example.

In some situations, there can be no advantage in rearranging of samples included in a sample string. In such a case, an original sample string needs to be encoded. The rearranging unit 116*a* therefore outputs an original sample string (a sample string that has not been rearranged) as well. Then the encoder 116*b* encodes the original sample string and the rearranged sample string by variable-length coding. The code amount of the code string obtained by variable-length coding of the original sample string is compared with the code amount of the code string obtained by variable-length coding of the rearranged sample string using different variable-length coding methods for different regions. If the code amount of the code string obtained by variable-length coding of the original sample string is the smallest, the code string obtained by variable-length coding of the original sample string is output. In this case, the encoder 116*b* also outputs auxiliary information (second auxiliary information) indicating whether the sample string corresponding to the code string is a rearranged sample string or not. One bit is enough for the second auxiliary information. Note that if the second auxiliary information indicates that the sample string corresponding to the code string is the original sample string in which the samples have not been rearranged, the first auxiliary information does not need to be output.

Furthermore, it is possible to predetermine to rearrange a sample string only if a prediction gain or an estimated prediction gain is greater than a predetermined threshold. This method takes advantage of the fact that when the prediction gain in speech or music is large, vocal cord vibration or vibration of a music instrument is strong and the periodicity is high. Prediction gain is the energy of original sound divided by the energy of a prediction residual. In encoding that uses linear predictive coefficients and PARCOR coefficients as parameters, quantized parameters can be used on the encoder and the decoder in common. Therefore, for example, the encoder 116*b* may use an i-th order quantized PARCOR coefficient k(i) obtained by other means, not depicted, provided in the encoder 11 to calculate an estimated prediction gain represented by the reciprocal of (1−k(i)*k(j)) multiplied for each order. If the calculated estimated value is greater than a predetermined threshold, the encoder 116*b* outputs a code string obtained by variable-coding of a rearranged sample; otherwise, the encoding unit 116*b* outputs a code string obtained by variable-coding of an original sample string. In that case, the second auxiliary information indicating whether the sample string corresponding to a code string is a rearranged sample string or not does not need to be output. That is, rearranging is likely to have a minimal effect in unpredictable noisy sound or silence and therefore rearranging is omitted to reduce waste of second auxiliary information and computation.

In an alternate configuration, the rearranging unit 116*a* may calculate a prediction gain or an estimated prediction gain. If the prediction gain or the estimated prediction gain is greater than a predetermined threshold, the rearranging unit 116*a* may rearrange a sample string and output the rearranged sample string to the encoder 116*b*; otherwise, the rearranging unit 116*a* may output a sample string input in the rearranging unit 116*a* to the encoder 116*b* without rearranging the sample sting. Then the encoder 116*b* may encode the sample string output from the rearranging unit 116*a* by variable-length coding.

In this configuration, the threshold is preset as a value common to the coding side and decoding side.

Note that Rice coding, arithmetic coding and run length coding taken as an example herein are all well-known and therefore detailed descriptions of these method are omitted.

Since a quantized PARCOR coefficient is a coefficient that can be converted from a linear predictive coefficient or an LSP parameter, first a quantized linear predictive coefficient or a quantized LSP parameter may be obtained using other means, not depicted, provided in the encoder 11, instead of obtaining a quantized PARCOR coefficient using other means, not depicted, provided in the encoder 11, then a quantized PARCOR coefficient may be obtained from the obtained parameter, and then an estimated prediction gain may be obtained. In essence, the estimated prediction gain is obtained based on a quantized coefficient corresponding to a linear predictive coefficient.

While an example has been described in which different variable-length coding methods are used according to the localization of the amplitudes of samples included in a sample string output from the rearranging unit 116*a*, the present invention is not limited to this encoding process. For example, an encoding process may be used in which one or more samples are treated as one symbol (encoding unit) and a code to be assigned to a sequence of one or more symbols (hereinafter referred to as a symbol sequence) is adaptively controlled depending on the symbol string immediately preceding the symbol sequence. One example of such encoding process may be adaptive arithmetic coding, which is used in JPEG 2000. In the adaptive arithmetic coding, a modeling process and arithmetic coding are performed. In the modeling process, a frequency table of a symbol sequence for arithmetic coding is selected from the immediately preceding symbol sequence. Then, arithmetic coding is performed in which a closed interval half line [0, 1] is partitioned into intervals in accordance with the provability of occurrence of a selected symbol sequence, and codes for the symbol sequence are assigned to binary fractional values indicating positions in the intervals. In an embodiment of the present invention, the modeling process sequentially divides a rearranged frequency-domain sample string (a quantized MDCT coefficient string in the example described above) into symbols, starting from the low frequency side, and selects a frequency table for arithmetic coding, and the arithmetic coding partitions a closed interval half line [0,1] into intervals according to the probability of occurrence of a selected symbol sequence and assigns codes for the symbol sequence to binary fractional values indicating positions in the intervals. Since rearranging has been performed to rearrange the sample string so that samples that have equal or nearly equal indicators (for example the absolute values of amplitudes) that reflect the sizes of the samples are gathered together in a cluster as has been described above, variations of the indicators reflecting the sizes of the samples between adjacent samples in the sample string are small, the accuracy of the frequency tables of symbols is high and the total code amount of codes obtained by the arithmetic coding of the symbols can be kept small.

Decoder

Figure 2:
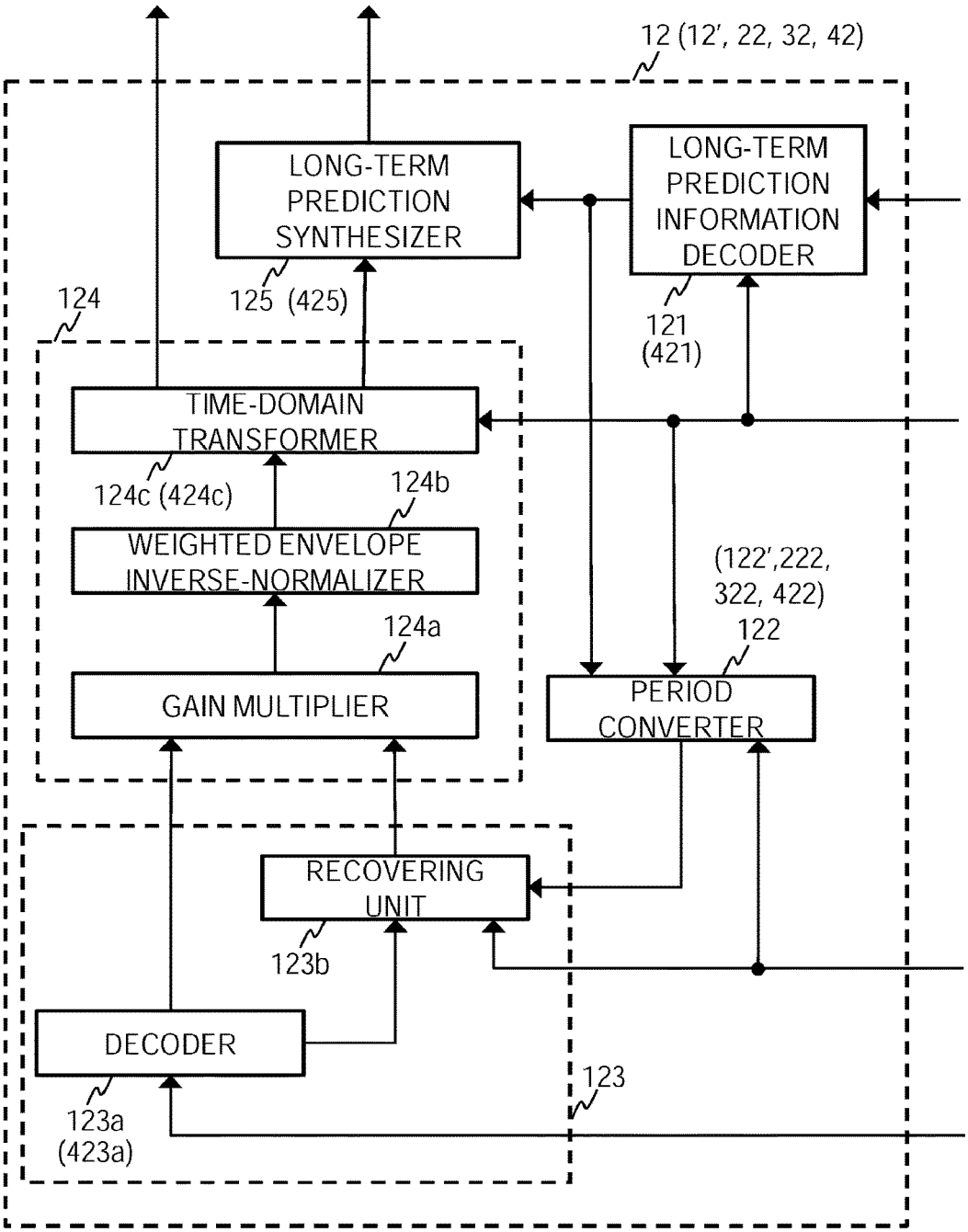
FIG. 2 is a block diagram of a decoder according to an embodiment.

A decoding process performed by the decoder 12 will be described with reference to FIG. 2.

At least the long-term prediction selection information, the gain information, the frequency-domain pitch period code, and the code string are input into the decoder 12. When the long-term prediction selection information indicates that long-term prediction is to be performed, at least a time-domain pitch period code $C_L$ is input. In addition to the time-domain pitch period code $C_L$, a pitch gain code $C_{gp}$ may be input. If selection information, first auxiliary information and second auxiliary information are output from the encoder 11, the selection information, the first auxiliary information and the second auxiliary information are also input into the decoder 12.

Frequency-Domain-Pitch-Period-Based Decoder 123

A frequency-domain-pitch-period-based decoder 123 includes a decoder 123*a* and a recovering unit 123*b*, decodes an input code string using a decoding method based on a frequency-domain pitch period T to obtain the original sequence of samples, and outputs the sequence of the samples.

Decoder 123*a*

The decoder 123*a* decodes an input code string on a frame-by-frame basis and outputs a frequency-domain sample string (step S123*a*).

If second auxiliary information is input in the decoder 12, the decoder 123*a* outputs the frequency-domain sample string obtained to a section, which depends on whether or not the second auxiliary information indicates that the sample string corresponding to the code string is a rearranged sample string. If the second auxiliary information indicates that the sample string corresponding to the code string is a rearranged sample string, the frequency-domain sample string obtained by the decoder 123*a* is output to the recovering unit 123*b*. If the second auxiliary information indicates that the sample string corresponding to the code string is a sample string that has not been rearranged, the frequency-domain sample string obtained by the decoder 123*a* is output to a gain multiplier 124*a*.

Furthermore, if the encoder 11 has made determination beforehand based on comparison between a prediction gain or an estimated prediction gain and a threshold as to whether to rearrange samples, the decoder 12 makes determination similar to the determination. Specifically, the decoder 123*a* uses an i-th order quantized PARCOR coefficient k(i) obtained by other means, not depicted, provided in the decoder 12 to calculate an estimated prediction gain represented by the reciprocal of (1−k(i)*k(j)) multiplied for each order. If the calculated estimated value is greater than a predetermined threshold, the decoder 123*a* outputs a frequency-domain sample string that the decoder 123*a* has obtained to the recovering unit 123*b*. Otherwise, the decoder 123*a* outputs an original frequency-domain sample string that the decoder 123*a* has obtained to the gain multiplier 124*a*.

Note that the means, not depicted, provided in the decoder 12 may obtain a quantized PARCOR coefficient by using a well-known method such as a method whereby a code corresponding to a PARCOR coefficient is decoded to obtain a quantized PARCOR coefficient or a method whereby a code corresponding to an LSP parameter is decoded to obtain a quantized LSP parameter and the obtained quantized LSP parameter is converted to obtain a quantized PARCOR coefficient. All of these methods obtain a quantized coefficient corresponding to a linear predictive coefficient from a code corresponding to a linear predictive coefficient. That is, an estimated prediction gain is based on a quantized coefficient corresponding to a linear predictive coefficient obtained by decoding a code corresponding to the linear predictive coefficient.

If selection information is input from the encoder 11 into the decoder 12, the decoder 123*a* performs a decoding process on an input code string by using a decoding method according to the selection information. Of course, a decoding method corresponding to the encoding method performed to obtain the coding string is performed. Details of the decoding process by the decoder 123*a* correspond to details of the encoding process by the encoder 116*b* of the encoder 11. Therefore, the description of the encoding process is incorporated here by stating that decoding corresponding to the encoding performed by the encoder 11 is the decoding process performed by the decoder 123*a*, and hereby a detailed description of the decoding process will be omitted. Note that if selection information is input, what type of encoding has been performed can be identified by the selection information. If selection information includes, for example, information identifying a region where Rice coding has been applied and Rice parameters, information indicating a region where run length coding has been applied, and information identifying the type of entropy coding, decoding methods corresponding to these encoding methods are applied to the corresponding regions of input coding strings. The decoding process corresponding to Rice coding, the decoding process corresponding to entropy coding, and the decoding process corresponding to run length coding are well known and therefore descriptions of these decoding processes will be omitted.

Long-Term Prediction Information Decoder 121

A long-term prediction information decoder 121 decodes an input time-domain pitch period code $C_L$ to obtain and output a time-domain pitch period L when long-term prediction selection information indicates that long-term prediction is to be performed. If a pitch gain code $C_{gp}$ is also input, the long-term prediction information decoder 121 also decodes the pitch gain code $C_{gp}$ to obtain and output a quantized pitch gain $g_p\hat{}$.

Period Converter 122

When long-term prediction selection information indicates that long-term prediction is to be performed, a period converter 122 decodes an input frequency-domain pitch period code to obtain an integer value indicating how many times a frequency-domain pitch period T is greater than a converted interval $T_1$, obtains the converted interval $T_1$ on the basis of a time-domain pitch period L and the number N of frequency-domain sample points according to formula (A4), multiplies the converted interval $T_1$ by the integer value to obtain and output the frequency-domain pitch period T.

When the long-term prediction selection information indicates that long-term prediction is not to be performed, the period converter 122 decodes the input frequency-domain pitch period code to obtain and output a frequency-domain pitch period T.

Recovering Unit 123*b*

Then, a recovering unit 123*b* obtains and outputs the original sequence of the samples from the frequency-domain sample string output from the decoder 123*a* on a frame-by-frame basis according to the frequency-domain pitch period T obtained by the period converter 122 or, if auxiliary information is input into the decoder 12, according to the frequency-domain pitch period T obtained by the period converter 122 and the input auxiliary information (step S123*b*). Here, the "original sequence of samples" is equivalent to the "frequency-domain sample string" output from the frequency-domain sample string arithmetic unit 113 of the encoder 11. While there are various rearranging methods that can be performed by the rearranging unit 116*a* of the encoder 11 and various possible rearranging alternatives corresponding to the rearranging methods as stated above, only one type of rearranging, if any, has been performed on the string, and the type of rearranging can be identified by the frequency-domain pitch period T and the auxiliary information.

Details of the recovering process performed by the recovering unit 123*b* correspond to the details of the rearranging process performed by the rearranging unit 116*a* of the encoder 11. Therefore, the description of the rearranging process is incorporated here by stating that the recovering process performed by the recovering unit 123*b* is the reverse of the rearranging performed by the rearranging unit 116*a* (rearranging in the reverse order), and hereby the detailed description of the recovering process will be omitted. In order to facilitate the understanding of the process, one example of the recovering process corresponding to the specific example of the rearranging process described previously will be described below.

For example, in the example described previously in which the rearranging unit 116*a* gathers sample groups together in a cluster at the low frequency side and outputs F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), . . . , F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax), the frequency-domain sample string F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), . . . , F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) output from the decoder 123*a* is input in the recovering unit 123*b*. Based on the frequency-domain pitch period T and the auxiliary information, the recovering unit 123*b* can recover the input sample string F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), . . . , F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) to the original sequence of samples F(j) ($1<j\leq jmax$).

Gain Multiplier 124*a*

Then, a gain multiplier 124*a* multiplies, on a frame-by-frame basis, each coefficient of the sample string output from the decoder 123*a* or the recovering unit 123*b* by a gain identified by the gain information described above to obtain and output a "normalized weighted normalized MDCT coefficient string" (step S124*a*).

Weighted Envelope Inverse-Normalizer 124*b*

Then, a weighted envelope inverse-normalizer 124*b* applies, on a frame-by-frame basis, a correction coefficient obtained from a transmitted power spectrum envelope coefficient string to each coefficient of the "normalized weighted normalized MDCT coefficient string" output from the gain multiplier 124*a* as described previously to obtain and output an "MDCT coefficient string" (step S124*b*). An example will be described in association with the example of the weighted envelope normalization process performed in the encoder 11. The weighted envelope inverse-normalizer 124*b* multiplies each coefficient in a "normalized weighted normalized MDCT coefficient string" output from the gain multiplier 124*a* by the P-th power ($0<\beta<1$) of each coefficient in a power spectrum envelope coefficient string that corresponds to the coefficient, $W(1)^{\beta}$, . . . , $W(N)^{\beta}$, to obtain the coefficients X(1), . . . , X(N) in an MDCT coefficient string.

Time-Domain Transformer 124*c*

Then, a time-domain transformer 124*c* transforms, on a frame-by-frame basis, the "MDCT coefficient string" output from the weighted envelope inverse-normalizer 124*b* into the time domain to obtain and output a signal string (time-domain signal string) in each frame (step S124*c*). When long-term prediction selection information output from the long-term prediction information decoder 121 indicates that long-term prediction is to be performed, the signal string obtained by the time-domain transformer 124*c* is input into a long-term prediction synthesizer 125 as a long-term prediction residual signal string $x_p(1), \ldots, x_p(N_t)$. When long-term prediction selection information output from the long-term prediction information decoder 121 indicates that long-term prediction is not to be performed, the signal sting obtained by the time-domain transformer 124*c* is output from the decoder 12 as a digital audio signal string $x(1), \ldots, x(N_t)$.

Long-Term Prediction Synthesizer 125

When long-term prediction selection information indicates that long-term prediction is to be performed, the long-term prediction synthesizer 125 obtains a digital audio signal string $x(1), \ldots, x(N_t)$ on the basis of a long-term prediction residual signal string $x_p(1), \ldots, x_p(N_t)$ obtained by the time-domain transformer 124*c*, a time-domain pitch period L and a quantized pitch gain $g_p\hat{}$ output from the long-term prediction information decoder 121, and a previous digital audio signal generated by the long-term prediction synthesizer 125 in accordance with formula (A5). If the long-term prediction information decoder 121 does not output a quantized pitch gain $g_p\hat{}$, that is, a pitch gain code $C_{gp}$ has not been input in the decoder 12, a predetermined value, for example 0.5, is used as $g_p\hat{}$. In this case, the value of $g_p\hat{}$ is stored in the long-term prediction information decoder 121 beforehand so that the encoder 11 and the decoder 12 can use the same value.

$$x(t)=x_p(t)+g_p\hat{}x(t-L) \tag{A5}$$

The signal string obtained by the long-term prediction synthesizer 125 is output as a digital audio signal string $x(1), \ldots, x(N_t)$ from the decoder 12.

When long-term prediction selection information indicates that long-term prediction is not to be performed, the long-term prediction synthesizer 125 does not perform anything.

As will be apparent from the embodiment, if for example a frequency-domain pitch period T is clear, efficient encoding can be accomplished by encoding a sample string rearranged according to the frequency-domain pitch period T (that is, the average code length can be reduced). Furthermore, since samples having equal or nearly equal indicators are gathered together in a cluster in a local region by rearranging a sample string, quantization distortion and the code amount can be reduced while enabling efficient encoding.

Modification of the First Embodiment

While the encoder 11 of the first embodiment chooses a frequency-domain pitch period T from among candidates that are a converted interval $T_1$ and integer multiples $U\times T_1$ of the converted interval $T_1$, the frequency-domain pitch period T may be chosen from candidates that include multiples of the converted interval $T_1$ other than integer multiples $U\times T_1$. Differences of a modification from the first embodiment will be described below.

Encoder 11'

An encoder 11' of this modification differs from the encoder 11 of the first embodiment in that the encoder 11' includes a frequency-domain pitch period analyzer 115' in place of the frequency-domain pitch period analyzer 115. In this modification, the frequency-domain pitch period analyzer 115' chooses and outputs a frequency-domain pitch period T from among candidates that are a converted interval $T_1$, integer multiples $U\times T_1$ of the converted interval $T_1$, and predetermined multiples of the converted interval $T_1$ other than the integer multiples $U\times T_1$. When the long-term predication selection information indicates that long-term prediction is not to be performed, the frequency-domain pitch period analyzer 115' chooses a frequency-domain pitch period T from among candidates that are integer value in a predetermined second range, as in the first embodiment.

Frequency-Domain Pitch Period Analyzer 115'

A frequency-domain pitch period analyzer 115' chooses a frequency-domain pitch period T from candidates that are a converted interval $T_1$, integer multiples $U\times T_1$ of the converted interval $T_1$, and predetermined multiples of the converted interval $T_1$ other than the integer multiples $U\times T_1$ (chooses a frequency-domain pitch period T from among candidates including the converted interval $T_1$ and integer multiples $U\times T_1$ of the converted interval $T_1$) and outputs the frequency-domain pitch period T and a frequency-domain pitch period code indicating how many times the frequency-domain pitch period T is greater than the converted interval $T_1$.

For example, if integers in a predetermined first range are greater than or equal to 2 and less than or equal to 9, a total of 16 values, namely a converted interval $T_1$, its integer multiples, $2T_1$, $3T_1$, $4T_1$, $5T_1$, $6T_1$, $7T_1$, $8T_1$, $9T_1$, and a predetermined multiples, $1.9375T_1$, $2.0625T_1$, $2.125T_1$, $2.1875T_1$, $2.25T_1$, $2.9375T_1$, and $3.0625T_1$, other than the integer multiples of the converted interval $T_1$ are candidates for the frequency-domain pitch period, from which a frequency-domain pitch period T is chosen. A frequency-domain pitch period code in this case is at least 4 bits long and is in one-to-one correspondence with each of the 16 candidates.

Note that the "integers in the predetermined first range" do not necessarily need to include all integers greater than or equal to a given integer and less than or equal to a given integer. For example, the integers in the predetermined first range may be integers greater than or equal to 2 and less than or equal to 9, excluding 5. In this case, for example a total of 16 values, namely a converted interval $T_1$, its integer multiples, $2T_1$, $3T_1$, $4T_1$, $6T_1$, $7T_1$, $8T_1$, $9T_1$, and a predetermined multiples, $1.3750T_1$, $1.53125T_1$, $2.03125T_1$, $2.0625T_1$, $2.09375T_1$, $2.1250T_1$, $8.5000T_1$, and $14.5000T_1$, other than the integer multiples of the converted interval $T_1$ are candidates for the frequency-domain pitch period, from which a frequency-domain pitch period T is chosen. A frequency-domain pitch period code in this case is at least 4 bits long and is in one-to-one correspondence with each of the 16 candidates.

When long-term prediction selection information indicates that long-term prediction is not to be performed, the frequency-domain pitch period analyzer 115' chooses a frequency-domain pitch period T from candidates that are integer values in a predetermined second range, as in the first embodiment.

Decoder 12'

A decoder 12' of this modification differs from the decoder 12 of the first embodiment in that the decoder 12' includes a period converter 122' in place of the period converter 122.

Period Converter 122'

When long-term prediction selection information indicates that long-term prediction is to be performed, a period converter 122' decodes a frequency-domain pitch period code to obtain a value (a multiple) indicating how many times a frequency-domain pitch period T is greater than a converted interval $T_1$, obtains the converted interval $T_1$ on the basis of a time-domain pitch period L and the number N of frequency-domain sample points according to formula (A4), multiplies the converted interval $T_1$ by the value indicating how many times greater to obtain and output the frequency-domain pitch period T.

When long-term prediction selection information indicates that long-term prediction is not to be performed, the period converter 122' decodes the frequency-domain pitch period code to obtain and output a frequency-domain pitch period T.

Modification 2 of First Embodiment

In modification 1 of the first embodiment, a frequency-domain pitch period T is chosen from candidates including multiples of a converted interval $T_1$ that are not integer multiples in addition to integer multiples $U \times T_1$ of the converted interval $T_1$. In modification 2 of the first embodiment, the fact that an integer multiple $U \times T_1$ is more likely to be a frequency-domain pitch period T than other values is taken into consideration and the length of a frequency-domain pitch period code is determined based on a variable-length code book.

A frequency-domain pitch period analyzer 115" chose a pitch period T by taking into consideration the length of a frequency-domain pitch period code as well.

Differences from modification 1 of the first embodiment will be described below. An encoder 11" of this modification differs from the encoder 11 of the first embodiment in that the encoder 11" includes the frequency domain pitch period analyzer 115" in place of the frequency-domain pitch period analyzer 115.

Frequency-Domain Pitch Period Analyzer 115"

The frequency-domain pitch period analyzer 115" chooses a frequency-domain pitch period T from candidates that are a converted interval $T_1$, integer multiples $U \times T_1$ of the converted interval $T_1$, and predetermined multiples of the converted interval $T_1$ other than the integer multiples $U \times T_1$ (chooses a frequency-domain pitch period T from among candidates including the converted interval $T_1$ and integer multiples $U \times T_1$ of the converted interval $T_1$) and outputs the frequency-domain pitch period T and a frequency-domain pitch period code indicating how many times the frequency-domain pitch period T is greater than the converted interval $T_1$.

Here, the frequency-domain pitch period code indicating how many times a frequency-domain pitch period T is greater than a converted interval $T_1$ is determined using a variable-length code book in which the lengths of codes corresponding to integer multiples $V \times T_1$ of the converted interval $T_1$ are shorter than the lengths of codes corresponding to the other candidates, where V is an integer. For example, V is an integer that is not 0 and is a positive integer, for example. For example, $V \in \{1, U\}$.

For example, a variable-length code book (example 1) may be used to choose a frequency-domain pitch period code in which the length of a variable-length code for a frequency-domain pitch period T that is equal to a converted interval $T_1$ itself and the length of a variable-length code for a frequency-domain pitch period T that is equal to an integer multiple $U \times T_1$ of the converted interval $T_1$ are shorter than the lengths of the other variable-length codes. Note that the "variable-length codes" are codes in which more likely events are assigned shorter codes than codes for unlikely events, thereby reducing the average code length. Such a frequency-domain pitch period code is shorter when the frequency-domain pitch period T is equal to the converted interval $T_1$ itself or an integer multiple of the converted interval $T_1$ than when the frequency-domain pitch period T is any other value. An example of such a variable-length code book is given in FIG. 12. Since an integer multiple of the converted interval $T_1$ is more likely to be chosen as a frequency-domain pitch period than other values, the average code length can be decreased by using such a variable-length code book to choose a frequency-domain pitch period code.

Alternatively, a variable-length code book (example 2) may be used to choose a frequency-domain pitch period code in which the length of a variable-length code for a frequency-domain pitch period T that is equal to a converted interval $T_1$ itself, the length of a variable-length code for a frequency-domain pitch period T that is equal to an integer multiple $U \times T_1$ of the converted interval $T_1$, the length of a variable-length code for a frequency-domain pitch period T that is close to the converted interval $T_1$, and the length of a variable-length code for a frequency-domain pitch period T that is close to an integer multiple $U \times T_1$ of the converted interval $T_1$ are shorter than the code lengths of other variable-length codes. The length of a frequency-domain pitch period code in this case is shorter when the frequency-domain pitch period T is equal to the converted interval $T_1$ itself, or an integer multiple of the converted interval $T_1$, or close to the converted interval $T_1$, or close to an integer multiple of the converted interval $T_1$ than when the frequency-domain pitch period T is any other value. Since the frequency-domain pitch period T that is equal to the converted interval $T_1$, or an integer multiple of the converted interval $T_1$, or close to the converted interval $T_1$, or close to an integer multiple of the converted interval $T_1$ is more likely to be chosen as the frequency-domain pitch period, the average code length can be reduced by making the lengths of the codes corresponding to these values shorter than the codes corresponding to the other values.

Alternatively, a variable-length code book (example 3) in which the length of a variable-length code for a frequency-domain pitch period T that is equal to a converted interval $T_1$ itself is shorter than the length of a variable-length code for a frequency-domain pitch period T that is equal to an integer multiple $U \times T_1$ of the converted interval $T_1$ may be used to choose a frequency-domain pitch period code. The length of a frequency-domain pitch period code in this case is shorter when the frequency-domain pitch period T is equal to the converted interval $T_1$ than when the frequency-domain pitch period T is close to the converted interval $T_1$.

Alternatively, a variable-length code book (example 4) in which the length of a variable-length code for a frequency-domain pitch period T that is an integer multiple $U \times T_1$ of the converted interval $T_1$ is shorter than the length of a variable-length code for a frequency-domain pitch period T that is close to an integer multiple $U \times T_1$ of the converted interval $T_1$ may be used. The length of a first frequency-domain pitch period code in this case is shorter when the first frequency-domain pitch period T is an integer multiple of the converted interval $T_1$ than when the first frequency-domain pitch period T is close to an integer multiple of the converted interval $T_1$.

If information about previous frames cannot be used or is not used as has been described previously, a smaller multiplier m*n for the converted interval $T_1$ of a frequency-domain pitch period T is more likely to be chosen as the frequency-domain pitch period T. By taking this fact into consideration, a variable-length code book (example 5) may be used to choose a frequency-domain pitch period code in which variable-codes are assigned so that at least the length of a variable-length code for a frequency-domain pitch period T that is an integer multiple $V \times T_1$ of the converted interval $T_1$ is monotonically non-decreasing with respect to the magnitude of the integer multiple V as illustrated in FIG. 13. In this case, at least the length of a frequency-domain pitch period code for the frequency-domain pitch period T that is an integer multiple $V \times T_1$ of the converted interval $T_1$ is monotonically non-decreasing with respect to the magnitude of the integer V.

Alternatively, a variable-length code book (example 6) that has a combination of the features of examples 1 and 3 described above may be used, or a variable-length code book (example 7) that has a combination of the features of examples 2 and 3 may be used, or a variable-length code book (example 8) that has a combination of the features of examples 2 and 4 may be used, or a variable-length code book (example 9) that has a combination of the features of examples 2, 3 and 4 may be used, or a variable-length code book (example 10) that has a combination of the features of any of examples 1 to 9 and the feature of example 5 may be used.

The frequency-domain pitch period analyzer 115" chooses a frequency-domain pitch period T by taking into consideration the length of a code that indicates the relationship between an indicator of the degree of concentration of energy on a sample group selected according to a predetermined rearranging rule and a converted interval $T_1$. For example, the frequency-domain pitch period analyzer 115" chooses a shorter code indicating the relationship with the converted interval $T_1$ from among codes that have the same indicator of the degree of concentration. Alternatively, the frequency-domain pitch period analyzer 115" chooses a frequency-domain pitch period T that maximizes a modified indicator of the degree of concentration:

modified indicator of degree of concentration=indicator of degree of concentration−$c$*(length of code indicating relationship with converted interval $T_1$)

where c is an appropriate predetermined constant (weight).

Second Embodiment

Encoder 21

An encoder 21 of a second embodiment differs from the encoder 11 of the first embodiment in that the encoder 21 includes a frequency-domain pitch period analyzer 215 in place of the frequency-domain pitch period analyzer 115. In this embodiment, when long-term prediction selection information indicates that long-term prediction is to be performed, the frequency-domain pitch period analyzer 215 chooses an intermediate candidate from among a converted interval $T_1$ and integer multiples $U \times T_1$ of the converted interval $T_1$, chooses a frequency-domain pitch period T from among the intermediate candidate and values in a predetermined third range that are close to the intermediate candidate, and outputs the frequency-domain pitch period T. When long-term prediction selection information indicates that long-term prediction is not to be performed, the frequency-domain pitch period analyzer 215 chooses a frequency-domain pitch period T from candidates that are integers in a predetermined second range, as in the first embodiment, and outputs the frequency-domain pitch period T. Differences from the first embodiment will be described below.

Frequency-Domain Pitch Period Analyzer 215

When long-term prediction selection information indicates that long-term prediction is to be performed, the frequency-domain pitch period analyzer 215 first chooses an intermediate candidate from among a converted interval $T_1$ and integer multiples $U \times T_1$ of the converted interval $T_1$. The frequency-domain pitch period analyzer 215 then chooses a frequency-domain pitch period T from among the intermediate candidate and values in a predetermined third range that are close to the intermediate candidate and outputs the frequency-domain pitch period T. In addition, the frequency-domain pitch period analyzer 215 outputs information indicating how many times the intermediate candidate is greater than the converted interval $T_1$ and information indicating the difference between the frequency-domain pitch period T and the intermediate candidate as frequency-domain pitch period codes.

For example, if the integers in a predetermined first range are greater than or equal to 2 and less than or equal to 8, a total of eight values, namely the converted interval $T_1$ and the values equal to 2 to 8 times the converted interval $T_1$, i.e. $2T_1$, $3T_1$, $4T_1$, $5T_1$, $6T_1$, $7T_1$ and $8T_1$, are candidates for the intermediate candidate, from which an intermediate candidate $T_{cand}$ is selected. Information indicating how many times the intermediate candidate is greater than the converted interval $T_1$ is a code that is at least 3 bits long and is in one-to-one correspondence with an integer greater than or equal to 1 and less than or equal to 8.

If the integers in a predetermined third range are greater than or equal to −3 and less than or equal to 4, for example, a total of eight values, namely $T_{cand}-3$, $T_{cand}-2$, $T_{cand}-1$, $T_{cand}$, $T_{cand}+1$, $T_{cand}+2$, $T_{cand}+3$, and $T_{cand}+4$ are candidates for the frequency-domain pitch period T, from which a frequency-domain pitch period T is chosen. In this case, information indicating the difference between the frequency-domain pitch period T and an intermediate candidate is a code that is at least 3 bits long and is in one-to-one correspondence with an integer greater than or equal to −3 and less than or equal to 4.

Note that the values in the predetermined third range may be integer values or fractional values. As in the modifications of the first embodiment, an intermediate candidate may be chosen from candidates that are not integer multiples $U \times T_1$ of a converted interval $T_1$ in addition to the converted interval $T_1$ and integer multiples $U \times T_1$ of the converted interval $T_1$. That is, an intermediate candidate may be chosen from candidates including the converted interval $T_1$ and integer multiples $U \times T_1$ of the converted interval $T_1$.

Decoder 22

A decoder 22 of this embodiment differs from the decoder 12 of the first embodiment in that the decoder 22 includes a period converter 222 in place of the period converter 122. In this embodiment, when long-term prediction selection information indicates that long-term prediction is to be performed, the period converter 222 decodes a frequency-domain pitch period code to obtain an integer value indicating how many times an intermediate candidate is greater than a converted interval $T_1$ and the difference between a frequency-domain pitch period T and the intermediate candidate, adds the difference to the converted interval $T_1$ multiplied by the integer value, and outputs the result as the frequency-domain pitch period T. When long-term prediction selection information indicates that long-term prediction is not to be performed, the period converter 222 decodes a frequency-domain pitch period code to obtain and output a frequency-domain pitch period T.

Third Embodiment

Encoder 31

An encoder 31 of a third embodiment differs from the encoders 11, 11', 21 of the first embodiment, the modifications of the first embodiment and the second embodiment in that the encoder 31 includes a frequency-domain pitch period analyzer 315 in place of the frequency-domain pitch period analyzer 115, 115', 215. The frequency-domain pitch period analyzer 315 of this embodiment performs a process in which the condition "when long-term prediction selection information indicates that long-term prediction is to be performed" is replaced with the condition "when quantized pitch gain $g_p^{\wedge}$ is greater than or equal to a predetermined value" and the condition "when long-term prediction selection information indicates that long-term prediction is not to be performed" is replaced with the condition "when quantized pitch gain $g_p^{\wedge}$ is smaller than a predetermined value". The rest of the process is the same as the process in the first and second embodiment. Note that this embodiment is predicated on a configuration in which the encoder 31 obtains a quantized pitch gain $g_p^{\wedge}$ and a pitch gain code $C_{gp}$ in the first embodiment.

Decoder 32

A decoder 32 of this embodiment differs from the decoders 12, 12', 22 of the first embodiment and the second embodiment in that the decoder 32 includes a period converter 322 in place of the period converter 122, 122', 222. The period converter 322 in this embodiment performs a process in which the condition "when long-term prediction selection information indicates that long-term prediction is to be performed" is replaced with the condition "when quantized pitch gain $g_p^{\wedge}$ is greater than or equal to a predetermined value" and the condition "when long-term prediction selection information indicates that long-term prediction is not to be performed" is replaced with the condition "when quantized pitch gain $g_p^{\wedge}$ is smaller than a predetermined value". The rest of the process is the same as the process in the first and second embodiment. Note that this embodiment is predicated on a configuration in which a pitch gain code $C_{gp}$ is input in the decoder 32 and a quantized pitch gain $g_p^{\wedge}$ in the first embodiment is obtained.

Fourth Embodiment

Encoder 41

An encoder 41 of a fourth embodiment differs from the encoders 11, 11', 21 of the first embodiment, the modifications of the first embodiment, and the second embodiment in that the encoder 41 includes a long-term prediction analyzer 411, a long-term prediction residual arithmetic unit 412, a frequency-domain transformer 413*a*, a period converter 414 and a frequency-domain pitch period analyzer 415 in place of the long-term prediction analyzer 111, the long term prediction residual arithmetic unit 112, the frequency-domain transformer 113*a*, the period converter 114, and the frequency-domain pitch period analyzer 115, 115', 215, respectively.

The long-term prediction analyzer 411 of this embodiment performs long term prediction regardless of the value of pitch gain $g_p$. More specifically, the long-term prediction analyzer 411 performs the same process as that performed by the long-term prediction analyzer 111 "when long-term prediction selection information indicates that long-term prediction is to be performed", regardless of the value of pitch gain $g_p$. Accordingly, the long-term prediction analyzer 411 does not need to determine whether or not to perform long-term prediction on the basis of whether or not the pitch gain $g_p$ is greater than or equal to a predetermined value and does not need to output long-term prediction selection information.

Then the long-term prediction residual arithmetic unit 412, the frequency-domain transformer 413*a*, the period converter 414 and the frequency-domain pitch period analyzer 415 perform a process equivalent to the process performed by the long-term prediction residual arithmetic unit 112, the frequency-domain transformer 113*a*, the period converter 114, and the frequency-domain pitch period analyzer 115, 115', 215, respectively, "when long-term prediction selection information output from the long-term prediction analyzer 111 indicates that long-term prediction is to be performed".

Decoder 42

A decoder 42 of this embodiment differs from the decoders 12, 12', 22 of the first embodiment and the second embodiment in that the decoder 42 includes a decoder 423*a*, a long-term prediction information decoder 421, a period converter 422, a time-domain transformer 424*c*, and a long-term prediction synthesizer 425 in place of the decoder 123*a*, the long-term prediction information decoder 121, the period converter 122, 122', 222, the time-domain transformer 124*c*, and the long-term prediction synthesizer 125, respectively. According to this embodiment, long-term prediction combining is performed regardless of long-term prediction selection information and the value of quantized pitch gain $g_p^{\wedge}$. Accordingly, long-term prediction selection information does not need to be input in the decoder 42 of this embodiment.

The decoder 423*a*, the long-term prediction information decoder 421, the period converter 422, the time-domain transformer 424*c*, and the long-term prediction synthesizer 425 of this embodiment perform a process equivalent to the process performed by the decoder 123*a*, the long-term prediction information decoder 121, the period converter 122, 122', 222, the time-domain transformer 124*c*, and the long-term prediction synthesizer 125 "when long-term prediction selection information indicates that long-term prediction is to be performed".

Alternatives

Each of the encoders 11, 11', 21, 31, 41 of the embodiments described above includes the frequency-domain transformer 113*a*, 413*a*, the weighted envelope normalizer 113*b*, the normalized gain arithmetic unit 113*c* and the quantizer 113*d*, and a quantized MDCT coefficient string in each frame obtained at the quantizer 113*d* is input into the frequency-domain pitch period analyzer 115, 115', 215, 315, 415. However, the encoder 11, 11', 21, 31, 41 may include processing sections other than the frequency-domain transformer 113*a*, 413*a*, the weighted envelope normalizer 113*b*, the normalized gain arithmetic unit 113*c* and the quantizer 113*d* or may perform a process with some of the processing sections given above being omitted. By way of example, the encoder 11, 11', 21, 31, 41 may include a frequency-domain sample string arithmetic unit 113 that includes the frequency-domain transformer 113*a*, 413*a*, the weighted envelope normalizer 113*b*, the normalized gain arithmetic unit 113*c* and the quantizer 113*d*. When long-term prediction is to be performed, the frequency-domain sample string arithmetic unit 113 provided in the encoder 11, 11', 21, 31, 41 performs the process for obtaining a frequency-domain sample string derived from a long-term prediction residual signal as described above; when long-term prediction is not to be performed, the frequency-domain sample string arithmetic unit 113 performs the process for obtaining a frequency-domain sample string derived from an audio signal as described above. The sample string obtained by the frequency-domain sample string arithmetic unit 113 is input into the frequency-domain pitch period analyzer 115, 115', 215, 315, 415.

The same applies to the decoders 12, 12', 22, 32, 42. By way of example, the decoder 12, 12', 22, 32, 42 may include a time-domain signal string arithmetic unit 124 that includes the gain multiplier 124*a*, the weighted envelope inverse-normalizer 124*b*, and the time-domain transformer 124*c*, 424*c*. The time-domain signal string arithmetic unit 124 provided in the decoder 12, 12', 22, 32, 42 performs a process for obtaining a time-domain signal string derived from a frequency-domain sample string input from the decoder 123*a*, 423*a* or the recovering unit 123*b*. When long-term prediction selection information output from the long-term prediction information decoder 121, 421 indicates that long term prediction is to be performed, a signal string obtained by the time-domain signal string arithmetic unit 124 is input in the long-term prediction synthesizer 125, 425 as a long-term prediction residual signal sting $x_p(1), \ldots, x_p(N_t)$. When long-term prediction selection information output from the long-term prediction information decoder 121, 421 indicates that long-term prediction is not to be performed, a signal string obtained by the time-domain signal string arithmetic unit 124 is output from the decoder 12, 12', 22, 32, 42 as a digital audio signal string $x(1), \ldots, x(N_t)$.

Fifth Embodiment

Encoder 51

Figure 8:
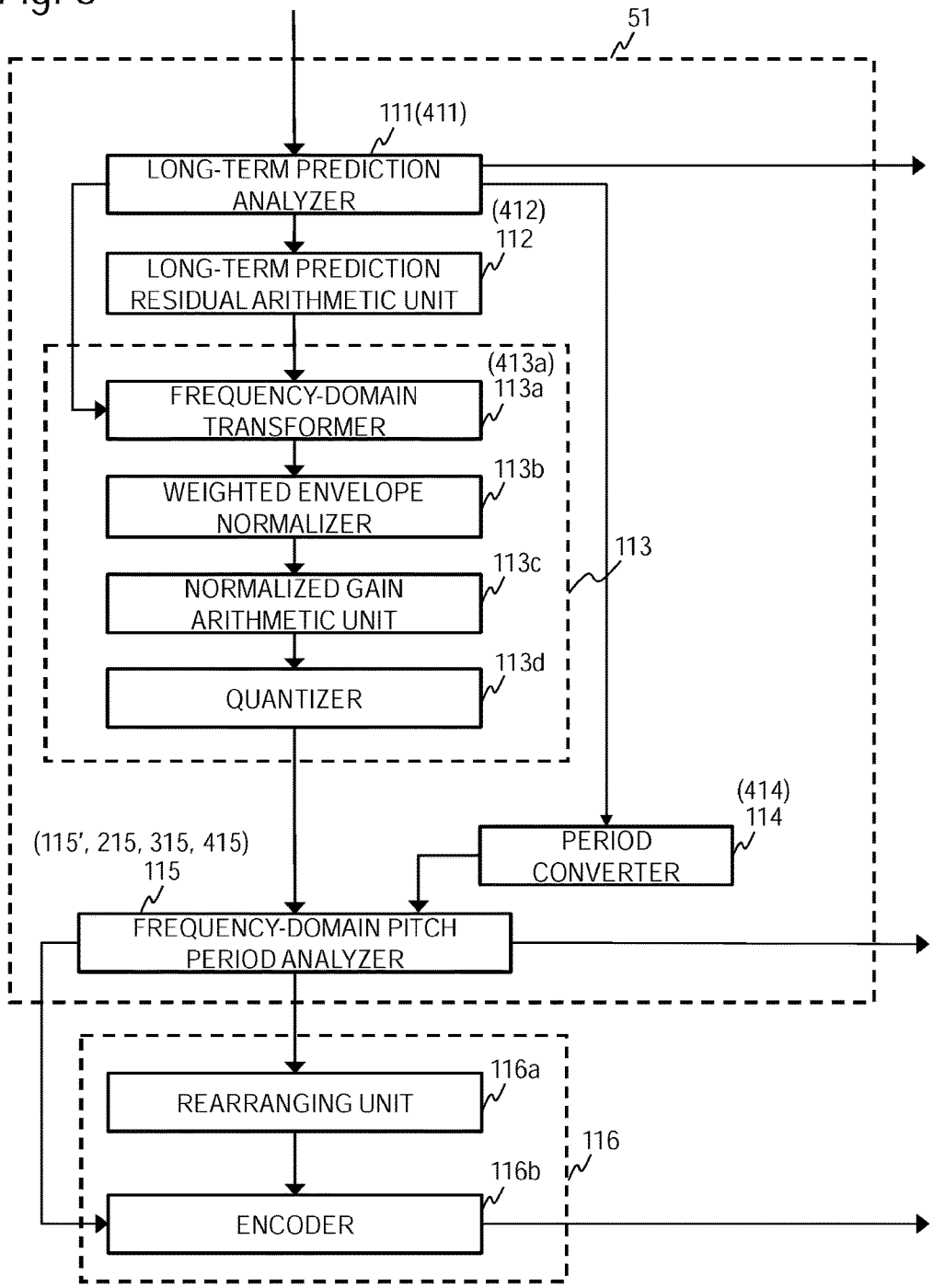
FIG. 8 is a block diagram of an encoder according to an embodiment.

As illustrated in FIG. 8, an encoder 51 of a fifth embodiment differs from the encoders 11, 11', 21, 31, 41 of the first embodiment, the modifications of the first embodiment, the second embodiment, the third embodiment and the fourth embodiment in that the encoder 51 does not include the frequency-domain-pitch-period-based encoder 116. The encoder 51 in this embodiment functions as an encoder that obtains a code for identifying a frequency-domain pitch period. If a frequency-domain sample string output from the encoder 51 is also to be encoded, the frequency-domain sample string output from the encoder 51 is input into a frequency-domain-pitch-period-based encoder 116 external to the encoder 51 and is encoded by the frequency-domain-pitch-period-based encoder 116, for example, although other encoding means may be used to encode the frequency-domain sample string. The rest of the encoder 51 is the same as the encoders 11, 11', 21, 31, 41 of the first embodiment, the modifications of the first embodiment, the second embodiment, the third embodiment and the fourth embodiment.

Decoder 52

Figure 9:
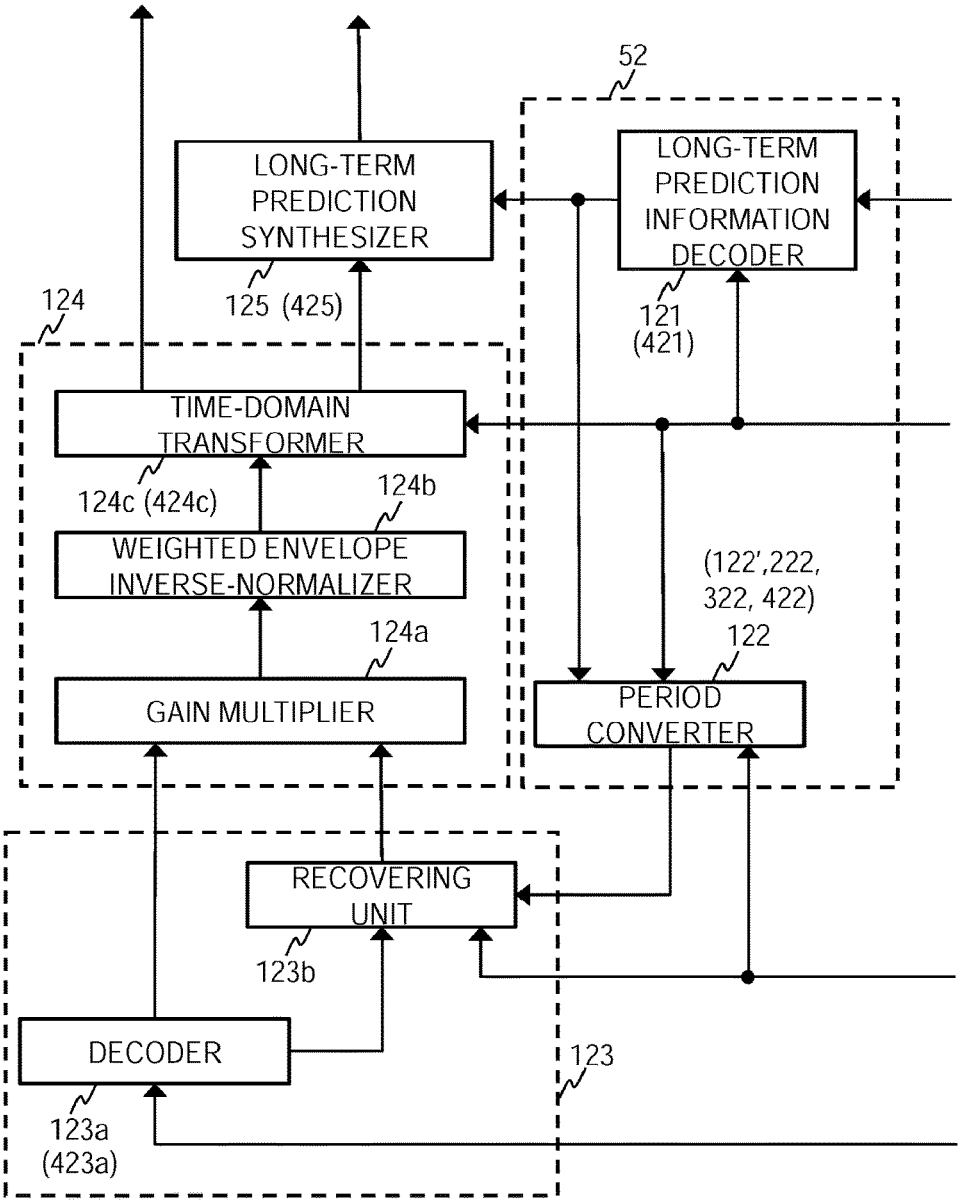
FIG. 9 is a block diagram of a decoder according to an embodiment.

As illustrated in FIG. 9, a decoder 52 of this embodiment differs from the decoders 12, 12', 22, 32, 42 of the first embodiment, the modifications of the first embodiment, the second embodiment, the third embodiment and the fourth embodiment in that the frequency-domain-pitch-period-based decoder 123, the time-domain signal string arithmetic unit 124 and the long-term prediction synthesizer 125 are external to the decoder 52. The decoder 52 functions as a decoder that obtains at least a long-term prediction frequency-domain pitch period T and a time-domain pitch period L from at least a frequency-domain pitch period code and a time-domain pitch period code contained in a code string. For example, a time-domain pitch period L and a quantized pitch gain $g_p\hat{}$ output from the decoder 52 are input into the long-term prediction synthesizer 125. For example, a code string and a frequency-domain pitch period T output from the decoder 52 (and auxiliary information if auxiliary information is input) are input into the frequency-domain-pitch-period-based decoder 123. The rest of the decoder 52 is the same as the decoders 12, 12', 22, 32, 42 of the first embodiment, the modifications of the first embodiment, the second embodiment, the third embodiment and the fourth embodiment.

Sixth Embodiment

Figure 10:
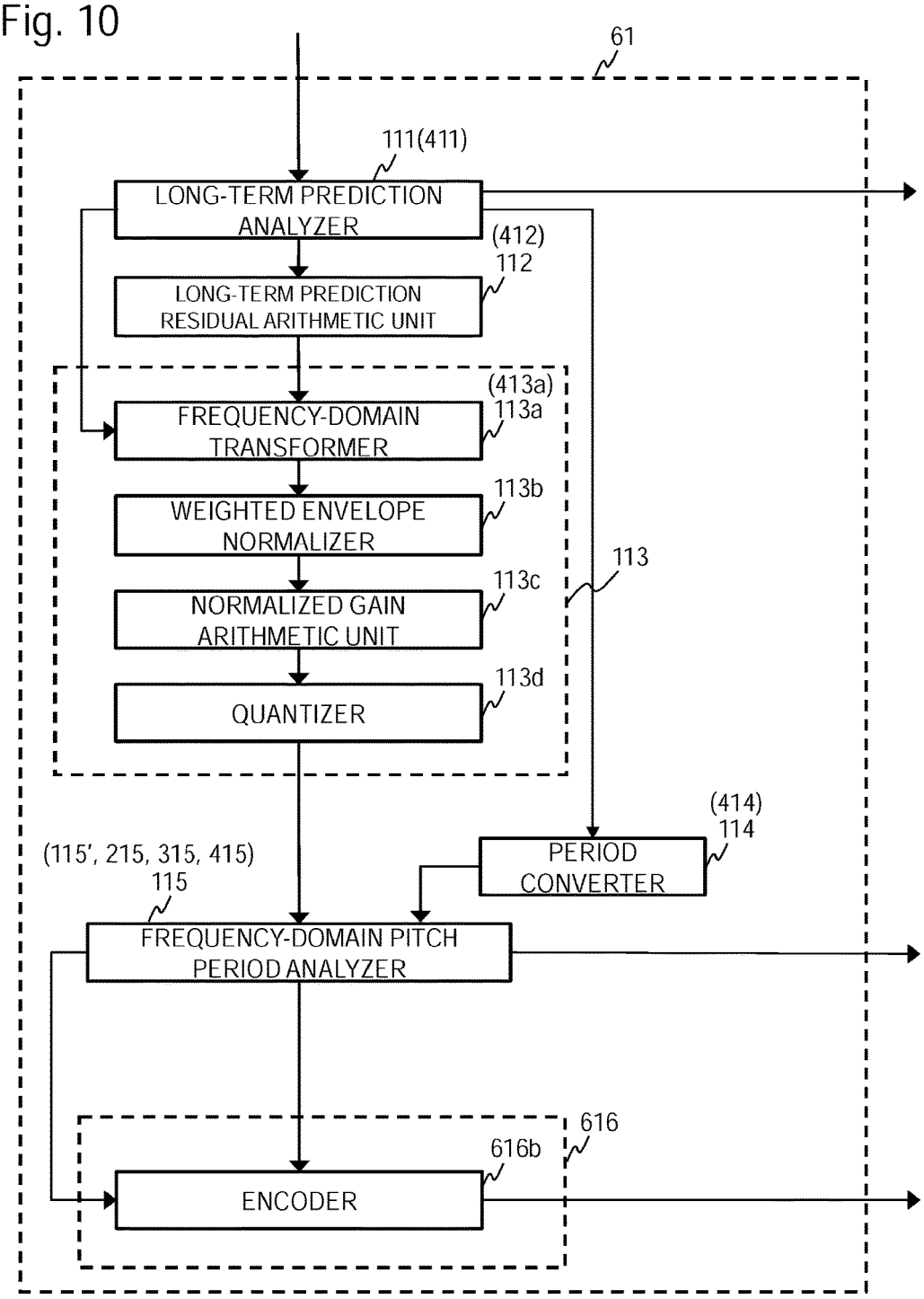
FIG. 10 is a block diagram of an encoder according to an embodiment.
Figure 11:
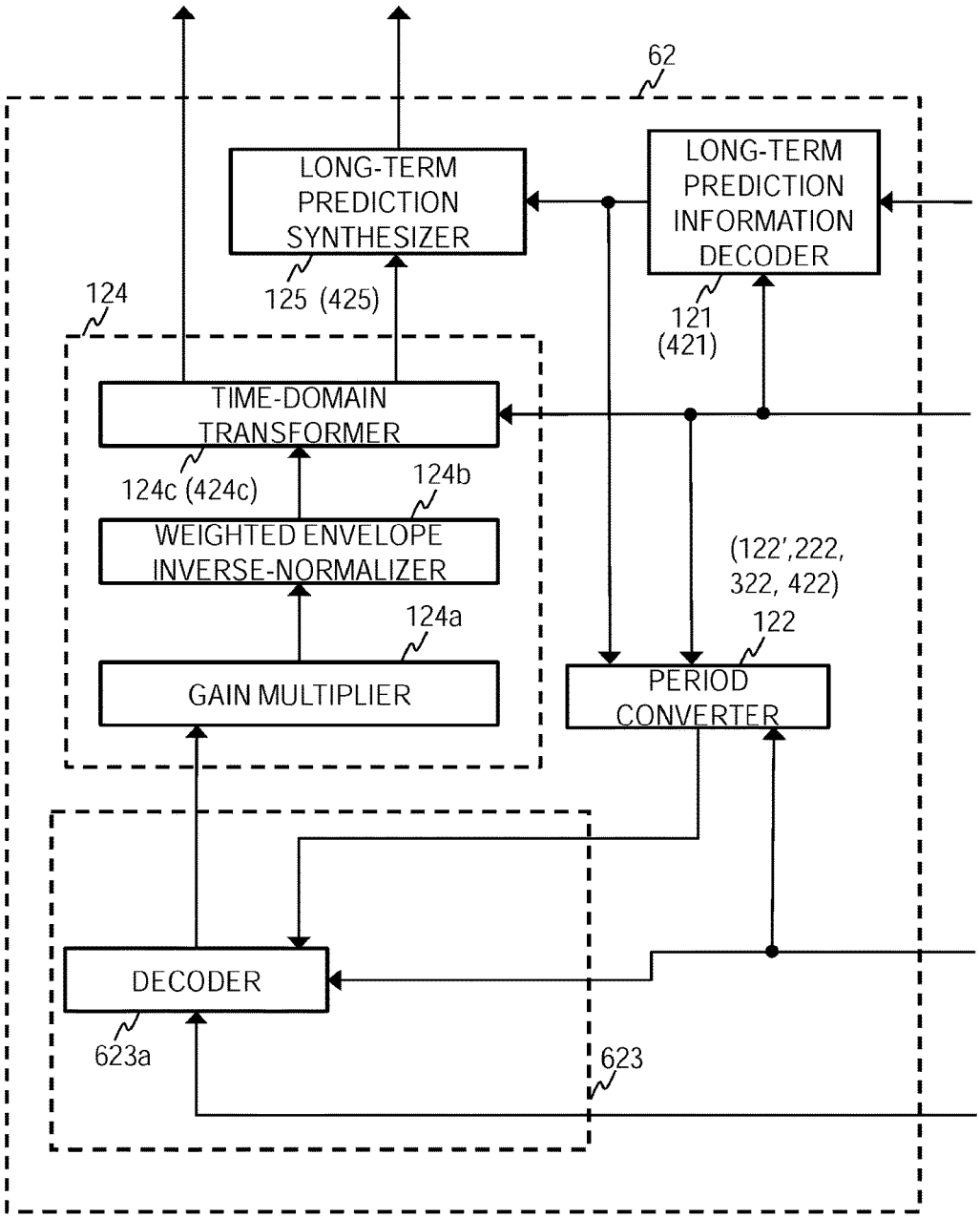
FIG. 11 is a block diagram of a decoder according to an embodiment.

As illustrated in FIGS. 10 and 11, an encoder 61 and a decoder 62 of a sixth embodiment differ from those of the first embodiment, the modifications of the first embodiment, the second embodiment, the third embodiment and the fourth embodiment in that a frequency-domain-pitch-period-based encoder 616 is configured in place of the frequency-domain-pitch-period-based encoder 116 and a frequency-domain-pitch-period-based decoder 623 is configured in place of the frequency-domain-pitch-period-based decoder 123. A frequency-domain sample string is input into the frequency-domain-pitch-period-based encoder 616. A code string, a frequency-domain pitch period T, and auxiliary information are input into the frequency-domain-pitch-period-based decoder 623. Only the frequency-domain-pitch-period-based encoder 616 and the frequency-domain-pitch-period-based decoder 623 will be described below.

Frequency-Domain-Pitch-Period-Based Encoder 616

The frequency-domain-pitch-period-based encoder 616 includes an encoder 616*b*, encodes an input frequency-domain sample string using an encoding method based on a frequency-domain pitch period T, and outputs code strings resulting from the encoding.

Encoder 616*b*

The encoder 616*b* encodes sample group G1 made up of all or some of one or a plurality of successive samples including a sample corresponding to a frequency-domain pitch period T in a frequency-domain sample string and one or a plurality of successive samples including a sample corresponding to an integer multiple of the frequency-domain pitch period T in the frequency-domain sample string and sample group G2 made up of the samples that are not included in the sample group G1 in the frequency-domain sample string in accordance with different criteria (separately) and outputs resulting code strings.

Examples of Sample Groups G1, G2

An example of the "all or some of one or a plurality of successive samples including a sample corresponding to a frequency-domain pitch period T in a frequency-domain sample string and one or a plurality of successive samples including a sample corresponding to an integer multiple of the frequency-domain pitch period T in the frequency-domain sample string" is the same as that given in the first embodiment and such a group of samples is the sample group G1. As has been described in the first embodiment, such sample group G1 can be set in various ways. For example, a set of sample groups each of which is made up of three samples, namely a sample F(nT) corresponding to an integer multiple of the frequency-domain pitch period T, the sample F(nT−1) preceding the sample F(nT) and the sample F(nT+1) succeeding the sample F(nT), F(nT−1), F(nT) and F(nT+1), in a sample string input in the encoder 616*b* is an example of the sample group G1. For example, if n represents an integer in the range of 1 to 5, the sample group G1 is a group made up of a first sample group F(T−1), F(T), F(T+1), a second sample group F(2T−1), F(2T), F(2T+1), a third sample group F(3T−1), F(3T), F(3T+1), a fourth sample group F(4T−1), F(4T), F(4T+1), and a fifth sample group F(5T−1), F(5T), F(5T+1).

A group of samples that are not included in the sample group G1 in the sample string input in the encoder 616*b* is the sample group G2. For example, if n represents an integer in the range of 1 to 5, an example of the sample group G2 is a group made up of a first sample set F(1), . . . , F(T−2), a second sample set F(T+2), . . . , F(2T−2), a third sample set F(2T+2), . . . , F(3T−2), a fourth sample set F(3T+2), . . . , F(4T−2), a fifth sample set F(4T+2), . . . , F(5T−2), and a sixth sample set F(5T+2), . . . , F(jmax).

If a frequency-domain pitch period T is a fractional value as illustrated in the first embodiment, the sample group G1 may be a set of sample groups made up of F(R(nT−1)), F(R(nT)), and F(R(nT+1)), for example, where R(nT) is a value nT rounded to the nearest integer. The number of samples included in each of the sample groups making up the sample group G1 and sample indices may be variable and information representing one combination selected from a plurality of different combinations of the number of samples included in each sample group making up the sample group G1 and sample indices may be output as auxiliary information (first auxiliary information).

[Examples of Encoding According to Different Criteria]

The encoder 616*b* encodes the sample group G1 and sample group G2 in accordance with different criteria without rearranging the samples included in the sample groups G1 and G2 and outputs the resulting code strings.

On average, the amplitudes of the samples included in the sample group G1 are greater than the amplitudes of the samples included in the sample groups G2. The samples in the sample group G1 are encoded using variable-length coding according to a criterion relating to the magnitudes of amplitudes or estimated magnitudes of amplitudes of the samples included in the sample group G1 and the samples included in the sample group G2 are encoded using variable-length coding according to a criterion relating to the magnitudes of amplitudes or estimated magnitudes of amplitudes of the sample in the sample group G2. With this configuration, the average code amount of variable-length codes can be reduced because a higher accuracy of estimation of the amplitudes of samples can be achieved than if all samples included in the sample string are encoded by variable-length coding according to the same criterion. That is, encoding the sample group G1 and sample group G2 according to different criteria has the effect of reducing the amount of the code of the sample string without rearranging the samples. Examples of the magnitude of amplitude include the absolute value of amplitude and energy of amplitude.

[Example of Rice Coding]

An example using sample-by-sample Rice coding as variable-length coding will be described.

In this case, the encoder 616*b* encodes the samples included in the sample group G1 by Rice coding on a sample-by-sample basis using a Rice parameter corresponding to the magnitude of amplitude of or an estimated magnitude of amplitude of each of the samples included in the sample group G1. The encoder 616*b* also encodes the samples included in the sample group G2 by Rice coding on a sample-by-sample basis using a Rice parameter corresponding to the magnitude of amplitude of or an estimated magnitude of amplitude of each of the samples included in the sample group G2. The encoder 616*b* outputs code strings obtained by the Rice coding and auxiliary information for identifying the Rice parameters.

For example, the encoder 616*b* obtains a Rice parameter for the sample group G1 in each frame from the average of magnitudes of amplitudes of the samples included in the sample group G1 in that frame. For example, the encoder 616*b* obtains a Rice parameter for the sample group G2 in each frame from the average of magnitudes of amplitudes of the samples included in the sample group G2 in that frame. A Rice parameter is an integer greater than or equal to 0. The encoder 616*b* uses, in each frame, the Rice parameter for the sample group G1 to encode the samples included in the sample group G1 by Rice coding and uses the Rice parameter for the sample group G2 to encode the samples included in the sample group G2 by Rice coding. This encoding can reduce the average code amount. This will be described below in detail.

First, an example will be given in which the samples included in the sample group G1 are encoded by Rice coding on a sample-by-sample basis.

A code that can be obtained by Rice coding of the samples X(k) included in the sample group G1 on a sample-by-sample basis includes prefix(k) resulting from unary coding of a quotient q(k) obtained by dividing the sample X(k) by a value corresponding to the Rice parameter s of the sample group G1 and sub(k) that identifies the remainder. That is, a code corresponding to a sample X(k) in this example includes prefix(k) and sub(k). Samples X(k) to be encoded by Rice coding are integer representations.

A method for calculating q(k) and sub(k) will be illustrated below. If Rice parameter s>0, then quotient q(k) is generated as follows. Here, floor(χ) is the maximum integer less than or equal to X.

$$q(k)=\mathrm{floor}(X(k)/2^{s-1})\ (\text{for } X(k)\geq 0) \tag{B1}$$

$$q(k)=\mathrm{floor}\{(-X(k)-1)/2^{s-1}\}\ (\text{for } X(k)<0) \tag{B2}$$

If Rice parameter s=0, quotient q(k) is generated as follows.

$$q(k)=2*X(k)\ (\text{for } X(k)\geq 0) \tag{B3}$$

$$q(k)=2*X(k)-1\ (\text{for } X(k)<0) \tag{B4}$$

If Rice parameter s>0, sub(k) is generated as follows.

$$\mathrm{sub}(k)=X(k)-2^{s-1}*q(k)+2^{s-1}\ (\text{for } X(k)\geq 0) \tag{B5}$$

$$\mathrm{sub}(k)=(-X(k)-1)-2^{s-1}*q(k)\ (\text{for } X(k)<0) \tag{B6}$$

If Rice parameter s=0, sub(k) is null (sub(k)=null).

Formulas (B1) to (B4) can be generalized to represent quotient q(k) as follows. Here, |•| represents the absolute value of •.

$$q(k)=\mathrm{floor}\{(2*|X(k)|-z)/2^{s}\}\ (z=0 \text{ or } 1 \text{ or } 2) \tag{B7}$$

In Rice coding, prefix(k) is a code resulting from unary coding of quotient q(k) and the amount of the code can be expressed using formula (B7) as $$\mathrm{floor}\{(2*X(k)|-z)/2^{s}\}+1 \tag{B8}$$

In Rice coding, sub(k) which identifies the remainder of formulas (B5) and (B6) is represented by s bits. Accordingly, the total code amount C(s, X(k), G1) of codes (prefix(k) and sub(k)) corresponding to the samples X(k) included in the sample group G1 is as follows:

$$C(s, X(k), G1)=\sum_{k\in G1}[\mathrm{floor}\{(2*|X(k)|-z)/2^{s}\}+1+s]$$

Here, by approximating as floor{(2*|X(k)|−z)/$2^s$}=(2*|X(k)|−z)/$2^s$, formula (B9) can be approximated as follows:

$$C(s, X(k), G1) = 2^{-s}(2*D - z*|G1|) + (1+s)\cdot|G1|$$

$$D = \sum_{k \in G1} |X(k)|$$

where |G1| represents the number of the samples X(k) included in the sample group G1 in one frame.

Let s' denotes s that yields 0 as the result of partial differentiation with respect to s in formula (B 10), then $$s' = \log_2\{\ln 2*(2*D/|G1| - z)\} \quad \text{(B11)}$$

If D/|G1| is sufficiently greater than z, formula (B11) can be approximated as $$s' = \log_2\{\ln 2*(2 - D/|G1|)\} \quad \text{(B12)}$$

Since s' obtained according to formula (B12) is not an integer, s' is quantized to an integer and is used as the Rice parameter s. The Rice parameter s corresponds to the average D/|G1| of the magnitudes of amplitudes of the samples included in the sample group G1 (see formula (B12)) and minimizes the total code amount of codes corresponding to the samples X(k) included in the sample group G1.

The foregoing applies to Rice coding of the samples included in the sample group G2 as well. Thus, the total code amount can be minimized by obtaining a Rice parameter for the sample group G1 from the average of the magnitudes of amplitudes of the samples included in the sample group G1 in each frame, obtaining a Rice parameter for the sample group G2 from the average of the magnitudes of amplitudes of the samples included in the sample group G2, and performing Rice coding of the sample group G1 and the sample group G2 separately.

The smaller variation in the magnitude of amplitude of samples X(k), the better the evaluation of the total code amount C(s, X(k), G1) according to approximated formula (B 10). Accordingly, especially when the magnitudes of amplitudes of the samples included in the sample group G1 are substantially uniform and the magnitudes of amplitudes of the samples included in the sample group G2 are substantially uniform, the amount of code can be more significantly reduced.

[Example 1 of Auxiliary Information for Identifying Rice Parameters]

If the Rice parameter for the sample group G1 and the Rice parameter for the sample group G2 are differentiated, the decoding side requires auxiliary information (third auxiliary information) for identifying the Rice parameter for the sample group G1 and auxiliary information (fourth auxiliary information) for identifying the Rice parameter for the sample group G2. Therefore, the encoder 616*b* may output the third auxiliary information and the fourth auxiliary information in addition to a code string of codes obtained by Rice coding of a sample string on a sample-by-sample basis.

[Example 2 of Auxiliary Information for Identifying Rice Parameters]

If an audio signal is to be encoded, the average of the magnitudes of amplitudes of the samples included in the sample group G1 is greater than the average of the magnitudes of amplitudes of the samples in the sample group G2 and a Rice parameter for the sample group G1 is greater than a Rice parameter for the sample group G2. By taking advantage of this fact, the code amount of auxiliary information for identifying the Rice parameters can be reduced.

For example, the assumption is made that a Rice parameter for the sample group G1 is greater than a Rice parameter for the sample group G2 by a fixed value (for example by 1). That is, the assumption is made that the relationship "Rice parameter for the sample group G1=Rice parameter for the sample group G2+fixed value" is invariably satisfied. In this case, the encoder 616*b* needs to output only one of the third auxiliary information and the fourth auxiliary information in addition to a code string.

[Example 3 of Auxiliary Information for Identifying Rice Parameters]

Information that by itself allows a Rice parameter for the sample group G1 to be identified may be set as fifth auxiliary information and information that allows a difference between the Rice parameter for the sample group G1 and a Rice parameter for the sample group G2 to be identified may be set as sixth auxiliary information. Alternatively, information that by itself allows a Rice parameter for the sample group G2 to be identified may be set as sixth auxiliary information and information that allows a difference between a Rice parameter for the sample group G1 and the Rice parameter for the sample group G2 to be identified may be set as fifth auxiliary information. Note that it is known that the Rice parameter for the sample group G1 is greater than the Rice parameter for the sample group G2, auxiliary information that indicates which of the Rice parameter for the sample group G1 and the Rice parameter for the sample group G2 is greater (such as information indicating positive or negative) is not required.

[Example 4 of Auxiliary Information for Identifying Rice Parameters]

If the number of code bits assigned to an entire frame is specified, the value of gain obtained at step S113*c* is significantly restricted and the range of values that can be taken on by the amplitudes of samples is also significantly restricted. In that case, the average of the magnitudes of amplitudes of samples can be estimated from the number of code bits assigned to an entire frame with a certain degree of accuracy. The encoder 616*b* may use a Rice parameter that can be estimated from an estimated average of the magnitudes of amplitude of the samples to perform Rice coding.

For example, the encoder 616*b* may use the estimated Rice parameter plus a first difference value (for example 1) as the Rice parameter for the sample group G1 and may use the estimated Rice parameter as the Rice parameter for the sample group G2. Alternatively, the encoder 616*b* may use the estimated Rice parameter as the Rice parameter for the sample group G1 and the estimated Rice parameter minus a second difference value (for example 1) may be used as the Rice parameter for the sample group G2.

The encoder 616*b* in either of these cases may output, for example, auxiliary information (seventh auxiliary information) for identifying the first difference value or auxiliary information (eighth auxiliary information) for identifying the second difference value, in addition to a code string.

[Example 5 of Auxiliary Information for Identifying Rice Parameters]

A Rice parameter that has a larger effect of reducing the code amount can be estimated based on envelope information of the amplitudes of a sample string X(1), . . . , X(N) when the magnitudes of amplitudes of the samples included in the sample group G1 or the magnitudes of amplitudes of the samples included in the sample group G2 are not uniform. For example, when the magnitudes of the amplitudes of the samples are larger in higher frequencies, the code amount can be reduced by increasing the Rice parameter for samples at the high band side among the samples included in the sample group G1 at a constant rate and increasing the Rice parameter for samples at the high band side among the samples included in the sample group G2 at a constant rate. An example is given below.

TABLE 1

| Envelope information | Rice parameter for sample group G1 | Rice parameter for sample group G1 |
|---|---|---|
| Amplitudes are uniform | s1 | s2 |
| Amplitudes are larger in higher frequencies | s1 (for 1 ≤ k < k1)<br>s1 + const. 1<br>(for k1 ≤ k ≤ N) | s2 (for 1 ≤ k < k1)<br>s2 + const. 2<br>(for k1 ≤ k ≤ N) |
| Amplitudes are smaller in higher frequencies | s1 + const. 3<br>(for 1 ≤ k < k1)<br>s1 (for k1 ≤ k ≤ N) | s2 (for 1 ≤ k < k1)<br>s2 + const. 4<br>(for k1 ≤ k ≤ N) |
| Amplitudes are larger in midrange frequencies than in higher and lower frequencies | s1 (for 1 ≤ k < k3)<br>s1 + const. 5<br>(for k3 ≤ k < k4)<br>s1 (for k4 ≤ k ≤ N) | s2 (for 1 ≤ k < k3)<br>s2 + const. 6<br>(for k3 ≤ k < k4)<br>s2 (for k4 ≤ k ≤ N) |
| Amplitudes are smaller in midrange frequencies than higher and lower frequencies | s1 + const. 7<br>(for 1 ≤ k < k3)<br>s1 (for k3 ≤ k < k4)<br>s1 + const. 8<br>(for k4 ≤ k ≤ N) | s2 + const. 9<br>(for 1 ≤ k < k3)<br>s2 (for k3 ≤ k < k4)<br>s2 + const. 10<br>(for k4 ≤ k ≤ N) |

In Table 1, s1 and s2 are Rice parameters for the sample groups G1 and G2, respectively, illustrated in [Examples 1 to 4 of Auxiliary Information for Identifying Rice Parameters] and const.1 to const.10 are predetermined positive integers. The encoder 616*b* in this example has only to output auxiliary information identifying envelope information (ninth auxiliary information) in addition to code strings and the pieces of auxiliary information illustrated in examples 2 and 3 of Rice parameters. If envelope information is already known to the decoding side, the encoder 616*b* does not need to output the ninth auxiliary information.

Frequency-Domain-Pitch-Period-Based Decoder 623

The frequency-domain-pitch-period-based decoder 623 includes a decoder 623*a* and decodes a code string using a decoding method based on a frequency-domain pitch period T to obtain and output a frequency-domain sample string.

Decoder 623*a*

The decoder 623*a* decodes code strings to obtain frequency-domain sample strings by (separate) decoding processes according to different criteria for the sample group G1 made up of all or some of one or a plurality of successive samples including a sample corresponding to a frequency-domain pitch period T in a frequency-domain sample string and one or a plurality of successive samples including a sample corresponding to an integer multiple of the frequency-domain pitch period T in the frequency-domain sample string and for the sample group G2 made up of the samples that are not included in the sample group G1 in the frequency-domain sample string and outputs frequency-domain sample strings.

[Examples of Code Groups C1, C2 and Sample Groups G1, G2]

The decoder 623*a* identifies the sample numbers included in the code groups C1 and C2 included in an input code string in each frame and the sample numbers included in the sample groups G1 and G2 corresponding to the code groups C1 and C2 by an input frequency-domain pitch period T (if first auxiliary information is input, by a frequency-domain pitch period T and the first auxiliary information), decodes the code groups C1 and C2, assigns the resulting sample value groups to the sample numbers corresponding to the codes to obtain the sample groups G1 and G2, thereby obtaining a frequency-domain sample string. The code group C1 is made up of codes corresponding to the samples included in the sample group G1 in the code string and the code group C2 is made up of codes corresponding to the samples included in the sample group G2 in the code string. The method for identifying the code groups C1 and C2 in the decoder 623*a* corresponds to a method for setting the sample groups G1 and G2 in the encoder 616*b*. For example, the "samples" in the description of the method for setting the sample groups G1 and G2 are replaced with "codes", "F(j)" with "C(j)", "sample group G1" with "code group C1", and "sample group G2" with "code group C2", where C(j) is a code corresponding to a sample F(j).

For example, if the sample group G1 is a group made up of three samples, namely a sample F(nT) corresponding to an integer multiple of the frequency-domain pitch period T, the sample preceding the sample F(nT) and the sample succeeding the sample F(nT), F(nT−1), F(nT) and F(nT+1), in a sample string input in the encoder 616*b*, the decoder 623*a* sets a group made up of codes C(nT−1), C(nT) and C(nT+1) corresponding to three sample numbers including the sample number nT corresponding to an integer multiple of the frequency-domain pitch period T, and the preceding and succeeding sample numbers nT−1 and nT+1, in an input code string C(1), . . . , C(jmax) as the code group C1, sets a group made up of the codes that are not included in the code group C1 as the code group C2, decodes each of the codes C(nT−1), C(nT), C(nT+1) included in the code group C1 to obtain a sample F(nT−1) with sample number nT−1, a sample F(nT) with sample number nT, and sample F(nT+1) with sample number nT+1, and decodes the codes included in the code group C2 to obtain samples with the sample numbers excluding sample numbers nT−1, nT and nT+1. For example, if n represents an integer from 1 to 5, the code group C1 is a group made up of a first code group C(T−1), C(t), C(T+1), a second code group C(2T−1), C(2T), C(2T+1), a third code group C(3T−1), C(3T), C(3T+1), a fourth code group C(4T−1), C(4T), C(4T+1), and a fifth code group C(5T−1), C(5T), C(5T+1); code group C2 is a group made up of a first code set C(1), . . . , C(T−2), a second code set C(T+2), . . . , C(2T−2), a third code set C(2T+2), . . . , C(3T−2), a fourth code set C(3T+2), . . . , C(4T−2), a fifth code set C(4T+2), . . . , C(5T−2), and a sixth code set C(5T+2), . . . , C(jmax). These code groups and code sets are decoded to obtain a first sample group F(T−1), F(T), F(T+1), a second sample group F(2T−1), F(2T), F(2T+1), a third sample group F(3T−1), F(3T), F(3T+1), a fourth sample group F(4T−1), F(4T), F(4T+1), a fifth sample group F(5T−1), F(5T), F(5T+1), a first sample set F(1), . . . , F(T−2), a second sample set F(T+2), . . . , F(2T−2), a third sample set F(2T+2), . . . , F(3T−2), a fourth sample set F(3T+2), . . . , F(4T−2), a fifth sample set F(4T+2), . . . , F(5T−2), and a sixth sample set F(5T+2), . . . , F(jmax), thereby obtaining a frequency-domain sample string.

[Example of Decoding According to Different Criteria]

The decoder 623*a* decodes the code group C1 and the code group C2 according to different criteria to obtain and output frequency-domain sample strings. For example, the decoder 623*a* decodes the codes included in the code group C1 according to a criterion relating to the magnitudes of amplitudes or estimated magnitudes of amplitudes of the samples included in the sample group G1 corresponding to the code group C1 and decodes the codes included in the code group C2 according to a criterion relating to the magnitudes of amplitudes or estimated magnitudes of amplitudes of the samples included in the sample group G2 corresponding to the code group C2.

[Example of Rice Coding]

An example will be described in which a code string has been obtained by sample-by-sample Rice coding.

In this case, the decoder 623*a*, on a frame-by-frame basis, sets a Rice parameter for the sample group G1 identified from input auxiliary information (at least some of the first to ninth auxiliary information) as the Rice parameter for the code group C1 and sets a Rice parameter for the sample group G2 identified from input auxiliary information as the Rice parameter for the code group C2. Methods for identifying the Rice parameters that correspond to [Examples 1 to 5 of Auxiliary Information for Identifying Rice Parameters] described previously will be illustrated below.

[For Example 1 of Auxiliary Information for Identifying Rice Parameters]

For example, the decoder 623*a* in which the third auxiliary information and the fourth auxiliary information have been input identifies a Rice parameter for the sample group G1 from the third auxiliary information and sets the Rice parameter as the Rice parameter for the code group C1 and identifies a Rice parameter for the sample group G2 from the fourth auxiliary information and sets the Rice parameter as the Rice parameter for the code group C2.

[For Example 2 of Auxiliary Information for Identifying Rice Parameters]

For example, the decoder 623*a* in which only the fourth auxiliary information has been input in addition to a code string identifies a Rice parameter for the code group C2 from the fourth auxiliary information and sets the Rice parameter for the code group C2 plus a fixed value (for example 1) as the Rice parameter for the code group C1. Alternatively, the decoder 623*a* in which only the third auxiliary information has been input in addition to a code string identifies a Rice parameter for the code group C1 from the third auxiliary information and sets the Rice parameter for the code group C1 minus a fixed value (for example 1) as the Rice parameter for the code group C2.

[For Example 3 of Auxiliary Information for Identifying Rice Parameters]

For example, the decoder 623*a* in which the fifth auxiliary information identifying a Rice parameter and sixth auxiliary information identifying a difference have been input identifies the Rice parameter for the sample group G1 from the fifth auxiliary information and sets the Rice parameter as the Rice parameter for the code group C1. Furthermore, the decoder 623*a* sets the Rice parameter for the code group C1 minus the difference identified from the sixth auxiliary information as the Rice parameter for the code group C2.

For example, the decoder 623*a* in which the fifth auxiliary information identifying a difference and the sixth auxiliary information identifying a Rice parameter have been input identifies the Rice parameter for the sample group G1 from the sixth auxiliary information and sets the Rice parameter as the Rice parameter for the code group C1. Furthermore, the decoder 623*a* sets the Rice parameter for the code group C2 plus the difference identified from the fifth auxiliary information as the Rice parameter for the code group C1.

[For Example 4 of Auxiliary Information for Identifying Rice Parameters]

For example, the decoder 623*a* in which the seventh auxiliary information has been input sets a Rice parameter estimated from the number of code bits assigned to an entire frame as the Rice parameter for the code group C2 and sets the Rice parameter for the code group C2 plus a first difference value identified from the seventh auxiliary information as the Rice parameter for the code group C1. For example, the decoder 623*a* in which the eighth auxiliary information has been input sets a Rice parameter estimated from the number of code bits assigned to an entire frame as the Rice parameter for the code group C1 and the Rice parameter for the code group C1 minus a second difference value identified from the eight auxiliary information as the Rice parameter for the code group C2.

[For Example 5 of Auxiliary Information for Identifying Rice Parameters]

For example, the decoder 623*a* in which the ninth auxiliary information has been input in addition to the auxiliary information for identifying the Rice parameters described above uses at least some of the third to eighth auxiliary information to identify s1 and s2 and adjusts s1 and s2 based on the ninth auxiliary information as illustrated in [Table 1] given above to obtain the Rice parameters for the code groups C1 and C2. If the ninth auxiliary information is not input but envelope information is known and the encoder 616*b* has adjusted s1 and s2 as illustrated in [Table 1] given above to obtain Rice parameters for the sample groups G1 and G2, the decoder 623*a* adjusts s1 and s2 as illustrated in [Table 1] given above to obtain the Rice parameters for the code groups C1 and C2.

The decoder 623*a* which has obtained the Rice parameters as described above uses the Rice parameter for the code group C1 to decode the codes included in the code group C1 in each frame and uses the Rice parameter for the code group C2 to decodes the codes included in the code group C2 to obtain and output the original sequence of samples. Note that decoding corresponding to Rice coding is well known and therefore the description of the decoding will be omitted.

Seventh Embodiment

In the sixth embodiment, an example has been given in which the frequency-domain-pitch-period-based encoder 616 is configured in the encoder 61 and the frequency-domain-pitch-period-based decoder 623 is configured in the decoder 62. However, the frequency-domain-pitch-period-based encoder 616 may be external to the encoder 61 and the frequency-domain-pitch-period-based decoder 623 may be external to the decoder 62. This difference is the same as the configuration difference of the fifth embodiment from the first embodiment, the modifications of the first embodiment, the second embodiment, third embodiment and fourth embodiment and therefore further description of the configuration will be omitted.

Eighth Embodiment

Encoder 81

Figure 14:
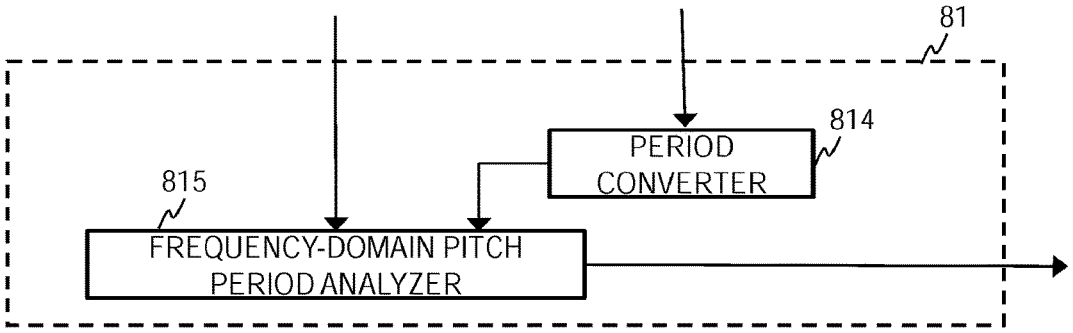
FIG. 14 is a lock diagram illustrating an encoder according to an embodiment.

As illustrated in FIG. 14, an encoder 81 of an eighth embodiment differs from the encoder 51 of the fifth embodiment in that the encoder 81 does not include the long-term prediction analyzer 111, the long-term prediction residual arithmetic unit 112, and the frequency-domain sample string arithmetic unit 113. The encoder 81 in this embodiment functions as an encoder that takes inputs of a time-domain pitch period L, a time-domain pitch period code $C_L$ and a frequency-domain sample string from a source external to the encoder 81 and obtains a code for identifying a frequency-domain pitch period for the frequency-domain sample string.

The time-domain pitch period L and the time-domain pitch period code $C_L$ to be input in the encoder 81 are calculated in an external long-term prediction analyzer 111.

However, they may be calculated by other time-domain pitch period calculation means.

The frequency-domain sample string input in the encoder 81 may be a sample string corresponding to a sample string resulting from conversion of an input digital audio signal string into N points in the frequency domain and may be a quantized MDCT coefficient string, for example, calculated in a frequency-domain sample string arithmetic unit 113 external to the encoder 81 or a frequency-domain sample string generated by other frequency-domain sample string generation means.

A period converter 814 of the encoder 81 takes inputs of a time-domain pitch period L and the number N of sample points in the frequency domain and calculates and outputs a converted interval $T_1$. The process for obtaining the converted interval $T_1$ is the same as the process performed by the period converter 114. Note that instead of the time-domain pitch period L, a time-domain pitch period code $C_L$ corresponding to the time-domain pitch period L may be input. In that case, the period converter 814 obtains the time-domain pitch period L corresponding to the input time-domain pitch period code $C_L$, obtains the converted interval $T_1$ from the time-domain pitch period L and outputs the converted interval $T_1$.

The converted interval $T_1$ and the frequency-domain sample string are input into a frequency-domain pitch period analyzer 815. The frequency-domain pitch period analyzer 815 chooses a frequency-domain pitch period from among candidates including the converted interval $T_1$ and integer multiples $U \times T_1$ (where U is an integer in a predetermined first range) of the converted interval $T_1$ and obtains and outputs a code for identifying the frequency-domain pitch period. The process for choosing the frequency-domain pitch period and the process for obtaining the code for identifying the frequency-domain pitch period are the same as those performed by the frequency-domain pitch period analyzers 115, 115', 215, 315, 415 when long-term prediction selection information indicates that long-term prediction is to be performed.

The period converter 814 and the frequency-domain pitch period analyzer 815 may perform different processes depending on whether the long-term prediction selection information indicates that long-term prediction is to be performed or not, like the period converters 114, 414 and the frequency-domain pitch period analyzers 115, 115', 215, 315, 415. In that case, the long-term prediction selection information is also input in the encoder 81 from a long-term prediction analyzer 111 external to the encoder 81.

Decoder 82

Figure 15:
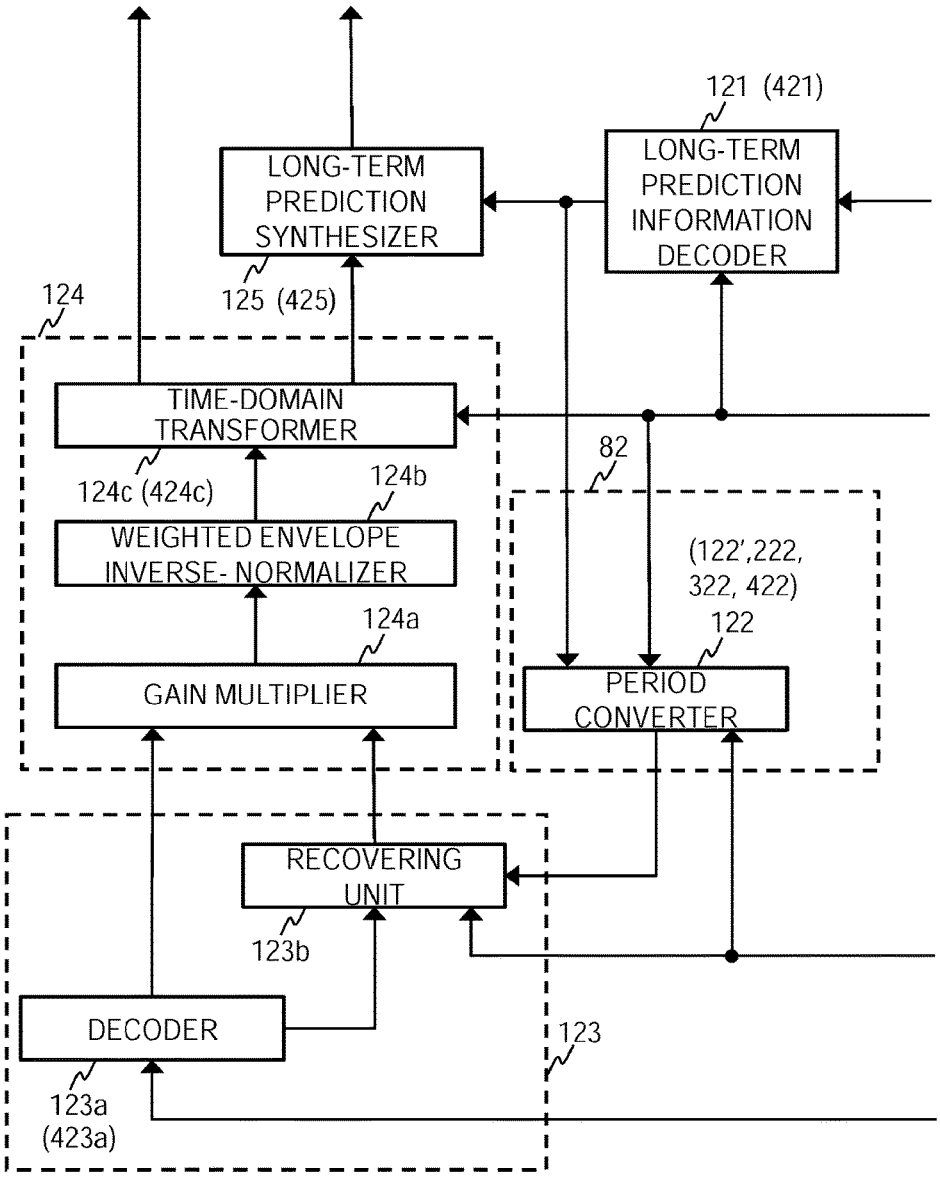
FIG. 15 is a block diagram of a decoder according to an embodiment.

As illustrated in FIG. 15, a decoder 82 of this embodiment differs from the decoder 52 of the fifth embodiment in that the decoder 82 does not includes the long-term prediction information decoder 121. The decoder 82 functions as a decoder that obtains at least frequency-domain pitch period T from a time-domain pitch period L obtained by a long-term prediction information decoder 121 external to the decoder 82 and from at least a frequency-domain pitch period code and a time-domain pitch period code included in an input code string. For example, a code string and a frequency-domain pitch period T output from the encoder 81 (and auxiliary information if auxiliary information is input) are input in a frequency-domain-pitch-period-based decoder 123. The rest of the decoder 82 is the same as the decoder 52 of the fifth embodiment.

Ninth Embodiment

Frequency-Domain Pitch Period Analyzer 91

In the fifth, seventh and eighth embodiments, a frequency-domain pitch period code corresponding to a frequency-domain pitch period T is output on the assumption that frequency-domain pitch period T obtained in the encoder 51, 81 is used in coding of frequency-domain sample strings in an external frequency-domain-pitch-period-based encoder 116, 616. However, the frequency-domain pitch period T may be used for purposes other than encoding and, in those cases, a frequency-domain pitch period code corresponding to the frequency-domain pitch period T does not need to be output. Purposes other than encoding may include analysis of speech, analysis of music, speech segregation, music segregation, speech recognition and music recognition, for example.

Figure 16:
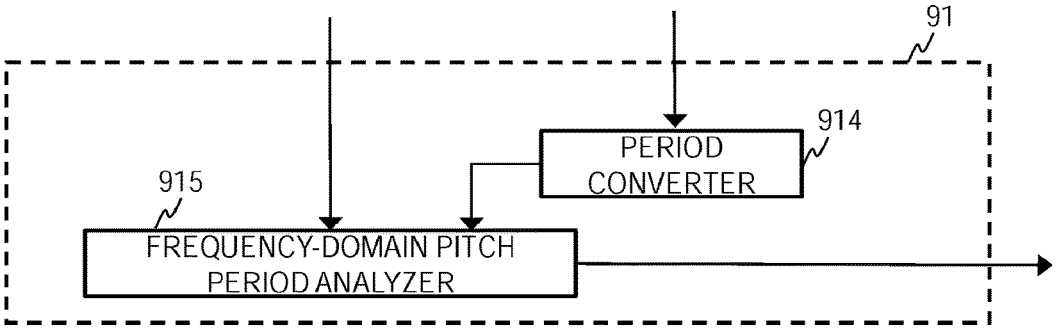
FIG. 16 is a block diagram of a frequency-domain pitch period analyzer according to an embodiment.

As illustrated in FIG. 16, a frequency-domain pitch period analyzer 91 of a ninth embodiment differs from the encoders 51, 81 of the fifth, seventh, and eighth embodiments in that the frequency-domain pitch period analyzer 91 does not output a frequency-domain pitch period code corresponding to a frequency-domain pitch period T. In this case, the frequency-domain pitch period analyzer 91 functions as a frequency-domain pitch period analyzer that determines a frequency-domain pitch period for a frequency-domain sample string from a time-domain pitch period L input from an external source.

A period converter 914 of the ninth embodiment takes inputs of a time-domain pitch period L and the number N of sample points in the frequency domain and calculates and outputs a converted interval $T_1$. The process for obtaining the converted interval $T_1$ is the same as that performed by the period converter 114.

A frequency-domain pitch period analyzer 915 takes inputs of the converted interval $T_1$ and the frequency-domain sample string, chooses a frequency-domain pitch period from among candidates including the converted interval $T_1$ and integer multiples $U \times T_1$ (where U is an integer in a predetermined first range) of the converted interval $T_1$ and outputs the chosen frequency-domain pitch period.

[Note]S

While configurations with the frequency-domain-pitch-period-based encoder 116 including the rearranging unit 116*a* and the encoder 116*b* have been described in the first embodiment, the modifications of the first embodiment, the second embodiment, the third embodiment, and the fourth embodiment and the configuration with the frequency-domain-pitch-period-based encoder including the encoder 616*b* has been described in the sixth embodiment, all of these frequency-domain-pitch-period-based encoders "encode an input frequency-domain sample string by an encoding method based on a frequency-domain pitch period T and output a code string obtained by the encoding". More specifically, all of these frequency-domain-pitch-period-based encoders "encode a sample group G1 made up of all or some of one or a plurality of successive samples including a sample corresponding to a frequency-domain pitch period T in a frequency-domain sample string and one or a plurality of successive samples including a sample corresponding to an integer multiple of the frequency-domain pitch period T in the frequency-domain sample string and a sample group made up of the samples that are not included in the sample group G1 in the frequency-domain sample string in accordance with different criteria (separately) and output code strings obtained by the encoding".

The same applies to the decoder. All of the frequency-domain-pitch-period-based decoders of the first embodiment, the modifications of the first embodiment, the second embodiment, the third embodiment and the fourth embodiments and the frequency-domain-pitch-period-based decoder of the sixth embodiment "decode an input code string by a decoding method based on a frequency-domain pitch period T and outputs a frequency-domain sample string". More specifically, all of these frequency-domain-pitch-period-based decoders "decode an input code string to produce a sample group made up of all or some of one or a plurality of successive samples including a sample corresponding to a frequency-domain pitch period T in a frequency-domain sample string and one or a plurality of successive samples including a sample corresponding to an integer multiple of the frequency-domain pitch period T in the frequency-domain sample string and a sample group made up of the samples that are not included in the sample group G1 in the frequency-domain sample string in accordance with different criteria (separately), thereby obtaining and outputting a frequency-domain sample string".

<Exemplary Hardware Configuration of Enoder/Decoder>

An encoder/decoder according to the embodiments described above includes an input section to which a keyboard and the like can be connected, an output section to which a liquid-crystal display and the like can be connected, a CPU (Central Processing Unit) (which may include a memory such as a cache memory), memories such as a RAM (Random Access Memory) and a ROM (Read Only Memory), an external storage, which is a hard disk, and a bus that interconnects the input section, the output section, the CPU, the RAM, the ROM and the external storage in such a manner that they can exchange data. A device (drive) capable of reading and writing data on a recording medium such as a CD-ROM may be provided in the encoder/decoder as needed. A physical entity that includes these hardware resources may be a general-purpose computer.

Programs for performing encoding/decoding and data required for processing by the programs are stored in the external storage of the encoder/decoder (the storage is not limited to an external storage; for example the programs may be stored in a read-only storage device such as a ROM.). Data obtained through the processing of the programs is stored on the RAM or the external storage device as appropriate. A storage device that stores data and addresses of its storage locations is hereinafter simply referred to as the "storage".

The storage of the encoder stores a program for rearranging a sample string included in a frequency domain that is derived from a speech/audio signal and a program for encoding the rearranged sample strings.

The storage of the decoder stores a program for decoding input code strings and a program for recovering the decoded sample strings to the original sample strings before rearranging by the encoder.

In the encoder, the programs stored in the storage and data required for the processing of the programs are loaded into the RAM as required and are interpreted and executed or processed by the CPU. As a result, the CPU implements given functions (such as the rearranging unit and encoder) to implement encoding.

In the decoder, the programs stored in the storage and data required for the processing of the programs are loaded into the RAM as required and are interpreted and executed or processed by the CPU. As a result, the CPU implements given functions (such as the decoder and recovering unit) to implement decoding. p <Addendum>

The present invention is not limited to the embodiments described above and modifications can be made without departing from the spirit of the present invention. Furthermore, the processes described in the embodiments may be performed not only in time sequence as is written or may be performed in parallel with one another or individually, depending on the throughput of the apparatuses that perform the processes or requirements. For example, the process by the long-term prediction information decoder 121 and the process by the decoder 123*a*, 523*a* in the decoding process described above may be performed in parallel.

If processing functions of any of the hardware entities (the encoder/decoder) described in the embodiments are implemented by a computer, the processing of the functions that the hardware entities should include is described in a programs. The program is executed on the computer to implement the processing functions of the hardware entity on the computer.

The programs describing the processing can be recorded on a computer-readable recording medium. An example of the computer-readable recording media is a non-transitory recording medium. The computer-readable recording medium may be any recording medium such as a magnetic recording device, an optical disc, a magneto-optical recording medium, and a semiconductor memory. Specifically, for example, a hard disk device, a flexible disk, or a magnetic tape may be used as a magnetic recording device, a DVD (Digital Versatile Disc), a DVD-RAM (Random Access Memory), a CD-ROM (Compact Disc Read Only Memory), or a CD-R (Recordable)/RW (ReWritable) may be used as an optical disk, MO (Magnet-Optical disc) may be used as a magneto-optical recording medium, and an EEP-ROM (Electronically Erasable and Programmable Read Only Memory) may be used as a semiconductor memory.

The program is distributed by selling, transferring, or lending a portable recording medium on which the program is recorded, such as a DVD or a CD-ROM. The program may be stored on a storage device of a server computer and transferred from the server computer to other computers over a network, thereby distributing the program.

A computer that executes the program first stores the program recorded on a portable recording medium or transferred from a server computer into a storage device of the computer. When the computer executes the processes, the computer reads the program stored on the recording medium of the computer and executes the processes according to the read program. In another mode of execution of the program, the computer may read the program directly from a portable recording medium and execute the processes according to the program or may execute the processes according to the program each time the program is transferred from the server computer to the computer. Alternatively, the processes may be executed using a so-called ASP (Application Service Provider) service in which the program is not transferred from a server computer to the computer but process functions are implemented by instructions to execute the program and acquisition of the results of the execution. Note that the program in this mode encompasses information that is provided for processing by an electronic computer and is equivalent to the program (such as data that is not direct commands to a computer but has the nature that defines processing of the computer).

While the hardware entities are configured by causing a computer to execute a predetermined program in the embodiments described above, at least some of the processes may be implemented by hardware.

What is claimed is:

1. An encoding method comprising:

a period conversion step of receiving a time-domain pitch period L corresponding to a time-domain pitch period code of an audio signal in a given time period, obtaining, as a converted interval $T_1$, a sample interval in an N-points frequency-domain sample string, the sample interval corresponding to the time-domain pitch period L, and outputting the time-domain pitch period code to a decoder;

a frequency-domain pitch period analysis step of receiving the N-points frequency-domain sample string derived from the audio signal in the given time period, choosing a first frequency-domain pitch period T from among a plurality of candidates including integer multiples $U \times T_1$ of the converted interval $T_1$, where U is an integer in a predetermined first range, the first frequency-domain pitch period T being a pitch period in the N-points frequency-domain sample string derived from the audio signal, obtaining a first frequency-domain pitch period code indicating how many times the first frequency-domain pitch period T is greater than the converted interval $T_1$, and outputting the first frequency-domain pitch period code to the decoder; and a frequency-domain-pitch-period-based encoding step of encoding a first sample group of all or some of one or a plurality of successive samples including a sample corresponding to the first frequency-domain pitch period T in the N-points frequency-domain sample string and one or a plurality of successive samples including a sample corresponding to an integer multiple of the first frequency-domain pitch period T in the N-points frequency-domain sample string in accordance with a first criterion corresponding to magnitudes of amplitudes or estimated magnitudes of amplitudes of samples included in the first sample group and encoding a second sample group of samples in the sample string that are not included in the first sample group in accordance with a second criterion corresponding to magnitudes of amplitudes or estimated magnitudes of amplitudes of samples included in the second sample group, to obtain a code string, and outputting the code string which is obtained by encoding the first sample group and the second sample group to the decoder, wherein the first sample group is a part of the N-points frequency-domain sample string.

2. A non-transitory computer-readable recording medium storing a program for causing a computer to execute the encoding method according to claim 1.

3. A decoding method comprising:

a long-term prediction information decoding step of receiving a time-domain pitch period code which is output from an encoder, and decoding the received time-domain pitch period code to obtain a time-domain pitch period L;

a period converting step of obtaining, as a converted interval $T_1$, a sample interval in an N-points frequency-domain sample string, the sample interval corresponding to the time-domain pitch period L, receiving a first frequency-domain pitch period code which is output from the encoder, decoding the received first frequency-domain pitch period code to obtain a multiple value indicating how many times a first frequency-domain pitch period T is greater than the converted interval $T_1$, and obtaining, as the first frequency-domain pitch period T, the converted interval $T_1$ multiplied by the multiple value; and a frequency-domain-pitch-period-based decoding step of receiving a code string which is output from the encoder, and decoding the code string by a decoding method in which a first sample group of all or some of one or a plurality of successive samples including a sample corresponding to the first frequency-domain pitch period T in the N-points frequency-domain sample string and one or a plurality of successive samples including a sample corresponding to an integer multiple of the first frequency-domain pitch period T in the N-points frequency-domain sample string is obtained by decoding processes according to a first criterion corresponding to magnitudes of amplitudes or estimated magnitudes of amplitudes of samples included in the first sample group and a second sample group of samples in the N-points frequency-domain sample string that are not included in the first sample group is obtained by decoding processes according to a second criterion corresponding to magnitudes of amplitudes or estimated magnitudes of amplitudes of samples included in the second sample group, to obtain and output the first sample group and the second sample group of the N-points frequency-domain sample string, wherein the first sample group is a part of the N-points frequency-domain sample string.

4. A non-transitory computer-readable recording medium storing a program for causing a computer to execute the decoding method according to claim 3.

5. An encoder comprising:

a period converter receiving a time-domain pitch period L corresponding to a time-domain pitch period code of an audio signal in a given time period, obtaining, as a converted interval $T_1$, a sample interval in an N-points frequency-domain sample string, the sample interval corresponding to the time-domain pitch period L, and outputting the time-domain pitch period code to a decoder;

a frequency-domain pitch period analyzer receiving the N-points frequency-domain sample string derived from the audio signal in the given time period, choosing a first frequency-domain pitch period T from among a plurality of candidates including integer multiples $U \times T_1$ of the converted interval $T_1$, where U is an integer in a predetermined first range, the first frequency-domain pitch period T being a pitch period in the N-points frequency-domain sample string derived from the audio signal, obtaining a first frequency-domain pitch period code indicating how many times the first frequency-domain pitch period T is greater than the converted interval $T_1$, and outputting the first frequency-domain pitch period code to the decoder; and a frequency-domain-pitch-period-based encoder encoding a first sample group of all or some of one or a plurality of successive samples including a sample corresponding to the first frequency-domain pitch period T in the N-points frequency-domain sample string and one or a plurality of successive samples including a sample corresponding to an integer multiple of the first frequency-domain pitch period T in the N-points frequency-domain sample string in accordance with a first criterion corresponding to magnitudes of amplitudes or estimated magnitudes of amplitudes of samples included in the first sample group and encoding a second sample group of samples in the sample string that are not included in the first sample group in accordance with a second criterion corresponding to magnitudes of amplitudes or estimated magnitudes of amplitudes of samples included in the second sample group, to obtain a code string, and outputting the code string which is obtained by encoding the first sample group and the second sample group to the decoder, wherein the first sample group is a part of the N-points frequency-domain sample string.

6. A decoder comprising:

a long-term prediction information decoder receiving a time-domain pitch period code which is output from an encoder, and decoding the received time-domain pitch period code to obtain a time-domain pitch period L;

a period converter obtaining, as a converted interval $T_1$, a sample interval in an N-points frequency-domain sample string, the sample interval corresponding to the time-domain pitch period L, receiving a first frequency-domain pitch period code which is output from the encoder, decoding the received first frequency-domain pitch period code to obtain a multiple value indicating how many times a first frequency-domain pitch period T is greater than the converted interval $T_1$, and obtaining, as the first frequency-domain pitch period T, the converted interval $T_1$ multiplied by the multiple value; and a frequency-domain-pitch-period-based decoder receiving a code string which is output from the encoder, and decoding the code string by a decoding method in which a first sample group of all or some of one or a plurality of successive samples including a sample corresponding to the first frequency-domain pitch period T in the N-points frequency-domain sample string and one or a plurality of successive samples including a sample corresponding to an integer multiple of the first frequency-domain pitch period T in the N-points frequency-domain sample string is obtained by decoding processes according to a first criterion corresponding to magnitudes of amplitudes or estimated magnitudes of amplitudes of samples included in the first sample group and a second sample group of samples in the N-points frequency-domain sample string that are not included in the first sample group is obtained by decoding processes according to a second criterion corresponding to magnitudes of amplitudes or estimated magnitudes of amplitudes of samples included in the second sample group, to obtain and output the first sample group and the second sample group of the N-points frequency-domain sample string, wherein the first sample group is a part of the N-points frequency-domain sample string.

* * * * *